US011130553B2

(12) United States Patent
Salisbury et al.

(10) Patent No.: US 11,130,553 B2
(45) Date of Patent: Sep. 28, 2021

(54) FOOT PEDAL FOR A TROLLING MOTOR ASSEMBLY

(71) Applicant: NAVICO HOLDING AS, Egersund (NO)

(72) Inventors: Alex Salisbury, Auckland (NZ); Jeremy J. Schroeder, Sapulpa, OK (US); Paul Robert Bailey, Auckland (NZ)

(73) Assignee: NAVICO HOLDING AS, Egersund (NO)

( * ) Notice: Subject to any disclaimer, the term of this patent is extended or adjusted under 35 U.S.C. 154(b) by 0 days.

(21) Appl. No.: 16/792,352

(22) Filed: Feb. 17, 2020

(65) Prior Publication Data

US 2020/0180743 A1 Jun. 11, 2020

Related U.S. Application Data

(63) Continuation of application No. 16/208,944, filed on Dec. 4, 2018, now Pat. No. 10,604,222.

(51) Int. Cl.
*B63H 20/00* (2006.01)
*B63H 20/08* (2006.01)
(Continued)

(52) U.S. Cl.
CPC ..... *B63H 20/007* (2013.01); *B63H 20/08* (2013.01); *B63H 20/12* (2013.01); *B63H 20/14* (2013.01); *B63H 21/21* (2013.01)

(58) Field of Classification Search
CPC ..... B60L 15/20; B63H 20/14; B63H 25/42; B63H 20/00; B63H 20/007; B63H 20/12; B63H 25/00; B63H 20/08; B63H 21/21
(Continued)

(56) References Cited

U.S. PATENT DOCUMENTS 2,804,838 A 9/1957 Moser
4,820,208 A 4/1989 Phillips, Sr.
(Continued)

FOREIGN PATENT DOCUMENTS

CA 2 895 863 A1 1/2016
DE 10 2007 009563 A1 8/2008
(Continued)

OTHER PUBLICATIONS

Minn Kota Ultrex Trolling Motor (5 pgs.) Website visited Feb. 20, 2019 https://minnkotamotors.johnsonoutdoors.com/freshwater-trolling-motors/ultrex.
(Continued)

*Primary Examiner* — Lars A Olson
(74) *Attorney, Agent, or Firm* — Nelson Mullins Riley & Scarborough LLP

(57) ABSTRACT

A user input assembly for controlling operation of a trolling motor assembly including a propulsion motor is provided herein. The user input assembly includes a support plate and a foot pedal defining a top surface that is configured to receive a user's foot thereon. The foot pedal is pivotably mounted to the support plate. A deflection sensor is in communication with the foot pedal and is configured to detect an angle of orientation of the foot pedal and output a signal corresponding with the angle of orientation of the foot pedal. The signal is receivable by a controller that is configured to control a direction of the propulsion motor of the trolling motor assembly. A feedback device is coupled with the foot pedal and configured to, in response to pivotal movement of the foot pedal about the first axis, provide a resistance force to the pivotal movement.

20 Claims, 25 Drawing Sheets

(51) Int. Cl.
*B63H 20/12* (2006.01)
*B63H 20/14* (2006.01)
*B63H 21/21* (2006.01)

(58) Field of Classification Search
USPC ..... 440/7
See application file for complete search history.

(56) References Cited

U.S. PATENT DOCUMENTS

| | | | | |
|---|---|---|---|---|
| 6,054,831 | A | 4/2000 | Moore et al. | |
| 6,325,685 | B1 * | 12/2001 | Knight | B63H 20/007 440/7 |
| 6,447,347 | B1 | 9/2002 | Steinhauser | |
| 6,507,164 | B1 | 1/2003 | Healey et al. | |
| 6,524,144 | B2 | 2/2003 | Pasley | |
| 6,661,742 | B2 | 12/2003 | Hansen | |
| 6,678,589 | B2 | 1/2004 | Robertson et al. | |
| 6,870,794 | B2 | 3/2005 | Healey | |
| 6,902,446 | B1 | 6/2005 | Healey | |
| 6,919,704 | B1 | 7/2005 | Healey | |
| 7,004,804 | B2 | 2/2006 | Bernloehr et al. | |
| 7,195,526 | B2 | 3/2007 | Bernloehr et al. | |
| 7,303,595 | B1 | 12/2007 | Janitz | |
| 7,538,511 | B2 | 5/2009 | Samek | |
| D594,034 | S | 6/2009 | Bernloehr et al. | |
| 7,722,417 | B2 | 5/2010 | Bernloehr et al. | |
| 8,106,617 | B1 | 1/2012 | Holley | |
| 8,305,844 | B2 | 11/2012 | DePasqua | |
| 8,645,012 | B2 | 2/2014 | Salmon et al. | |
| 8,761,976 | B2 | 6/2014 | Salmon et al. | |
| 8,814,129 | B2 | 8/2014 | Todd et al. | |
| 8,879,359 | B2 | 11/2014 | DePaaqua | |
| 9,127,707 | B1 | 9/2015 | Huntley | |
| 9,132,900 | B2 | 9/2015 | Salmon et al. | |
| 9,160,210 | B2 | 10/2015 | Perry | |
| 9,162,743 | B2 | 10/2015 | Grace et al. | |
| 9,278,745 | B2 | 3/2016 | Kooi, Jr. et al. | |
| 9,290,256 | B1 | 3/2016 | Wireman et al. | |
| 9,296,455 | B2 | 3/2016 | Bernloehr et al. | |
| 9,676,462 | B2 | 6/2017 | Bernloehr et al. | |
| 10,513,322 | B2 | 12/2019 | Clark et al. | |
| 2002/0102888 | A1 | 8/2002 | Pasley | |
| 2003/0191562 | A1 | 10/2003 | Robertson et al. | |
| 2003/0203684 | A1 | 10/2003 | Healey | |
| 2005/0257761 | A1 | 11/2005 | Hayase et al. | |
| 2006/0116031 | A1 | 6/2006 | Bernloehr et al. | |
| 2009/0037040 | A1 | 2/2009 | Salmon et al. | |
| 2009/0227158 | A1 | 9/2009 | Bernloehr et al. | |
| 2010/0116967 | A1 | 5/2010 | Todd et al. | |
| 2012/0014220 | A1 | 1/2012 | DePasqua | |
| 2012/0015566 | A1 | 1/2012 | Salmon | |
| 2012/0204467 | A1 | 8/2012 | Palmer et al. | |
| 2012/0232719 | A1 | 9/2012 | Salmon et al. | |
| 2013/0044569 | A1 | 2/2013 | DePasqua | |
| 2013/0215719 | A1 | 8/2013 | Betts et al. | |
| 2014/0203162 | A1 | 7/2014 | Logan | |
| 2014/0249698 | A1 | 9/2014 | Salmon et al. | |
| 2014/0269164 | A1 | 9/2014 | Betts et al. | |
| 2014/0277851 | A1 | 9/2014 | Grace et al. | |
| 2015/0016130 | A1 | 1/2015 | Davis et al. | |
| 2015/0063059 | A1 | 3/2015 | DePasqua | |
| 2015/0063060 | A1 | 3/2015 | DePasqua | |
| 2015/0151824 | A1 | 6/2015 | Wireman | |
| 2015/0346729 | A1 | 12/2015 | Grace et al. | |
| 2016/0016651 | A1 | 1/2016 | Anderson et al. | |
| 2018/0244361 | A1 | 8/2018 | Laster | |
| 2019/0176950 | A1 | 6/2019 | Whiteside et al. | |

FOREIGN PATENT DOCUMENTS

| | | |
|---|---|---|
| DE | 10 2014 106826 A1 | 11/2015 |
| EP | 1 891 461 B1 | 5/2014 |
| WO | WO 95/28682 | 10/1995 |
| WO | WO 2004/005063 A1 | 1/2004 |
| WO | WO 2013/126761 A1 | 8/2013 |
| WO | WO 2014/144471 A1 | 9/2014 |

OTHER PUBLICATIONS

MotorGuide® Product Guide—The Digital Advantage (48 pgs.) Downloaded Feb. 22, 2019 http://www.motorguide.com/userfiles/file/catalog/2004.pdf.

U.S. Appl. No. 15/835,752, filed Dec. 8, 2017, entitled "Foot Pedal for a Trolling Motor Assembly".

* cited by examiner

FOOT PEDAL FOR A TROLLING MOTOR ASSEMBLY

CROSS-REFERENCE TO RELATED APPLICATION(S)

This application claims priority to and is a continuation of U.S. patent application Ser. No. 16/208,944, entitled "Foot Pedal for a Trolling Motor Assembly" filed Dec. 4, 2018, which is hereby incorporated by reference in its entirety.

FIELD OF THE INVENTION

Embodiments of the present invention relate generally to trolling motor assemblies and, more particularly, to systems, assemblies, and associated methods for controlling a trolling motor assembly.

BACKGROUND OF THE INVENTION

Trolling motors are often used during fishing or other marine activities. The trolling motors attach to the watercraft and propel the watercraft along a body of water. For example, trolling motors may provide secondary propulsion or precision maneuvering that can be ideal for fishing activities. The trolling motors, however, may also be utilized for the main propulsion system of watercraft. Accordingly, trolling motors offer benefits in the areas of ease of use and watercraft maneuverability, among other things. That said, further innovation with respect to the operation/control of trolling motors is desirable. Applicant has developed systems, assemblies, and methods detailed herein to improve capabilities of trolling motors.

BRIEF SUMMARY OF THE INVENTION

Depending on the desired activity, an operator or user of the watercraft with the trolling motor may wish to remotely operate the trolling motor (e.g., not have to be positioned directly adjacent the trolling motor and/or have "hands free" control thereof). In this regard, the user may want to utilize a user input assembly such as, but not limited to, a foot pedal.

Some foot pedal assemblies for controlling the operation of trolling motors provide an electrical signal based on a foot pedal position to electronically steer the trolling motor. The electrical signal is provided to a controller that, in turn, controls an actuator that articulates the trolling motor's position/direction and, thus, propulsion direction. This contrasts with a traditional style in which movement of a pedal pulls mechanical cables that manually articulate the trolling motor's position/direction and, thus, propulsion direction. The traditional style provides a resistance to movement, as the user has to provide enough torque to physically rotate the trolling motor. The electronically steered foot pedal assemblies do not provide such as resistance force. It may be desirable, however, for some users to feel the resistance as a form of feedback for the user. Thus, some embodiments of the present disclosure provide feedback resistance in response to a user adjusting the foot pedal position.

In an example embodiment, a user input assembly for controlling operation of a trolling motor assembly is provided. The trolling motor assembly comprises a propulsion motor. The user input assembly comprises a support plate and a foot pedal pivotably mounted to the support plate about a first axis. The foot pedal defines a top surface that is configured to receive a user's foot thereon. The user input assembly includes a deflection sensor in communication with the foot pedal. The deflection sensor is configured to detect an angle of orientation of the foot pedal and output a signal corresponding with the angle of orientation of the foot pedal. The signal is receivable by a controller that is configured to control a direction of the propulsion motor of the trolling motor assembly. The user input assembly further includes a feedback device coupled with the foot pedal and configured to, in response to pivotal movement of the foot pedal about the first axis, provide a resistance force to the pivotal movement.

In some embodiments, the feedback device is a rotary damper.

In some embodiments, the user input assembly further comprises a first shaft that is rotationally fixed to the foot pedal and a second shaft that is pivotable about a second axis that is parallel to and offset from the first axis. The user input assembly further includes a gear train coupling the first shaft to the second shaft. The gear train is configured to cause the second shaft to rotate at a greater angular speed than the first shaft. The feedback device comprises a rotating element that is coupled with the second shaft so that the rotating element rotates about the second axis. In some embodiments, the rotating element comprises a drum brake comprising a drum that is rotationally fixed to the second shaft. In some embodiments, the brake drum is rotationally fixed to the second shaft. In some embodiments, the gear ratio of the first gear to the second gear is greater than 1:1.

In some embodiments, the feedback device comprises a motor having a rotor and a stator.

In some embodiments, the feedback device comprises a brake disk that pivots about the first axis and engages a brake pad. In some embodiments, the brake disk pivots about the first axis.

In some embodiments, a resistance of the feedback device is selectable by a user.

In some embodiments, the feedback device provides the resistance force by providing a resistance force that is proportional to an angular speed at which the foot pedal pivots about the first axis.

In another example embodiment, a user input assembly for controlling operation of a trolling motor assembly is provided. The trolling motor assembly comprises a propulsion motor. The user input assembly comprises a support plate and a foot pedal pivotably mounted to the support plate about a first axis. The foot pedal defines a top surface that is configured to receive a user's foot thereon, wherein the foot pedal is rotationally fixed to a first shaft. The user input assembly includes a second shaft that is generally parallel to the first shaft and configured to rotate about a second axis. The user input assembly further includes a first gear that is rotationally fixed to the first shaft and a second gear that is rotationally fixed to the second shaft and that engages the first gear so that the second shaft is rotationally coupled with the first shaft. The user input assembly further includes a deflection sensor that is configured to detect a pivotal angle of the second shaft. The deflection sensor is configured to communicate the detected pivotal angle to a controller that is configured to control a direction of the propulsion motor of the trolling motor assembly. The user input assembly further includes a feedback device comprising a rotating element. The feedback device is configured to resist movement of the second shaft, thereby resisting movement of the foot pedal about the first axis.

In some embodiments, the feedback device comprises a rotary damper that is rotationally fixed to the second shaft.

In some embodiments, the feedback device creates a resistive force that is proportional to an angular speed at which the foot pedal pivots about the first axis.

In some embodiments, the rotating element comprises a brake disk that pivots about the second axis and engages a brake pad.

In yet another example embodiment, a user input assembly for controlling operation of a trolling motor assembly is provided. The trolling motor assembly comprises a propulsion motor. The user input assembly comprises a support plate and a foot pedal pivotally mounted to the support plate about a first axis. The foot pedal defines a top surface that is configured to receive a user's foot thereon. The user input assembly further includes a flywheel pivotable about a second axis and a coupling between the foot pedal and the flywheel so that movement of the foot pedal at a first angular speed causes the flywheel to pivot about the second axis at a second angular speed that is greater than the first angular speed so that inertia of the flywheel resists change in pivotal rotation speed of the foot pedal. The coupling between the foot pedal and the flywheel is one of a gear train or a pulley system.

In some embodiments, the coupling between the foot pedal and the flywheel is a gear train, and the gear train is a planetary gear train.

In some embodiments, the second axis is parallel to the first axis.

In some embodiments, the second axis is perpendicular to the first axis.

In some embodiments, the foot pedal includes an engagement surface that is sized to receive a user's foot thereon. The user input assembly comprises a switch disposed on the foot pedal adjacent to and outside of the engagement surface. The switch is disposed on the foot pedal such that the switch pivots with the foot pedal. The switch is associated with at least one function corresponding to the trolling motor assembly or a watercraft on which the trolling motor assembly is mounted.

Some existing foot pedals for controlling the operation of trolling motors have buttons attached to a fixed, non-pivotable support plate that communicate with a controller. However, depending on the angle of the foot pedal, in some foot pedal positions, such buttons may be difficult to reach, while in other foot pedal positions, such buttons may subject to accidental actuation. Thus, some embodiments of the present disclosure seek to provide a foot pedal with buttons that are properly accessible independent of the foot pedal position and, in some cases, are disposed on the rotating part of the foot pedal assembly (thereby providing for easy access by a user).

In an example embodiment, a user input assembly for controlling operation of a trolling motor assembly is provided. The trolling motor assembly comprises a propulsion motor. The user input assembly comprises a support plate and a foot pedal pivotably mounted to the support plate about a first axis. The foot pedal includes a top surface that defines a left edge, right edge, a toe edge, and a heel edge. The top surface comprises an engagement surface that is sized to receive a user's foot thereon. The user input assembly includes a switch disposed on the foot pedal adjacent to and outside of the engagement surface. The switch is disposed on the foot pedal such that the switch pivots with the foot pedal. The switch is associated with at least one function corresponding to the trolling motor assembly or a watercraft on which the trolling motor assembly is mounted. The user input assembly includes a controller configured to determine an instance in which the switch is activated and cause, in response to determining an instance in which the switch is activated, an indication that the switch has been activated to be provided to a remote computing device for causing execution of the function associated with the switch.

In some embodiments, the switch defines a body comprising a main portion and a raised portion. The raised portion extends upwardly from the main portion so that the raised portion comprises a highest portion of the switch in a vertical dimension. In some embodiments, the switch comprises a proximate end and a distal end. The proximate end is closer to the engagement surface than the distal end. The raised portion is positioned closer to the distal end of the switch than the proximate end of the switch.

In some embodiments, the switch is disposed on the foot pedal closer to the toe edge than to the heel edge.

In some embodiments, the user input assembly comprises a second switch disposed on the foot pedal adjacent to and outside of the engagement surface. The second switch is disposed on the foot pedal such that the second switch pivots with the foot pedal. In some embodiments, the first switch and second switch are disposed on a same side of the engagement surface. In some embodiments, the first switch is disposed on a first side of the engagement surface and the second switch is disposed on a second side of the engagement surface that is opposite the first side. The first switch is pivotally mounted to the user input assembly. The second switch is pivotally mounted to the user input assembly. In some embodiments, the first switch and the second switch are pivotally mounted to a same axis.

In some embodiments, the function associated with the switch is maintaining the watercraft at a virtual anchor position.

In some embodiments, the function associated with the switch is locking a direction of movement of the watercraft on a specific heading.

In some embodiments, the function associated with the switch is programmable to perform a user-selected function.

In another example embodiment, a system is provided. The system comprises a trolling motor and a controller configured to cause the trolling motor to change at least one of a speed or an angle of orientation. The system further includes a user input assembly comprising a support plate and a foot pedal pivotably mounted to the support plate about a first axis. The foot pedal includes a top surface that defines a left edge, a right edge, a toe edge, and a heel edge. The top surface comprises an engagement surface that is sized to receive a user's foot thereon. The user input assembly further includes a switch disposed on the foot pedal adjacent to and outside of the engagement surface. The switch is disposed on the foot pedal such that the switch pivots with the foot pedal. The switch is associated with at least one function corresponding to the trolling motor or a watercraft on which the trolling motor is mounted. The controller is configured to determine an instance in which the switch is activated and cause, in response to determining an instance in which the switch is activated, execution of the function associated with the switch.

In some embodiments, the switch defines a body comprising a main portion and a raised portion. The raised portion extends upwardly from the main portion so that the raised portion comprises a highest portion of the switch in a vertical dimension. In some embodiments, the switch comprises a proximate end and a distal end. The proximate end is closer to the engagement surface than the distal end. The raised portion is positioned closer to the distal end than the proximate end.

In some embodiments, the user input assembly comprises a second switch disposed on the foot pedal adjacent to and outside of the engagement surface. The second switch is disposed on the foot pedal such that the second switch pivots with the foot pedal. In some embodiments, the first switch and second switch are disposed on a same side of the engagement surface.

In some embodiments, the first switch is disposed on a first side of the engagement surface and the second switch is disposed on a second side of the engagement surface that is opposite the first side. The first switch is pivotally mounted to the user input assembly. The second switch is pivotally mounted to the user input assembly. In some embodiments, the first switch and the second switch are pivotally mounted to a same axis.

In yet another example embodiment, a user input assembly for controlling operation of a trolling motor assembly is provided. The trolling motor assembly comprises a propulsion motor. The user input assembly comprises a support plate and a foot pedal pivotably mounted to the support plate about a first axis. The foot pedal includes a top surface that comprises an engagement surface that is sized to receive a user's foot thereon. The user input assembly includes a switch disposed on the foot pedal adjacent to and outside of the engagement surface. The switch is disposed on the foot pedal such that the switch pivots with the foot pedal. The switch is associated with at least one function corresponding to the trolling motor assembly or a watercraft on which the trolling motor assembly is mounted.

In some embodiments, the user input assembly further comprises a feedback device coupled with the foot pedal and configured to, in response to pivotal movement of the foot pedal about the first axis, provide a resistance force to the pivotal movement.

BRIEF DESCRIPTION OF THE DRAWINGS

Figure 1:
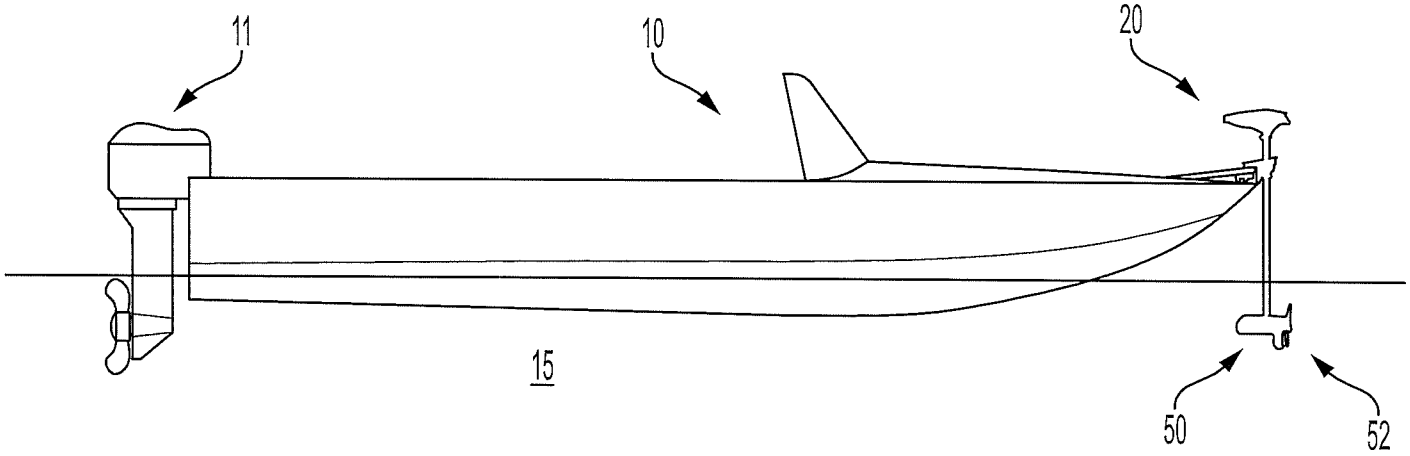
Figure 2:
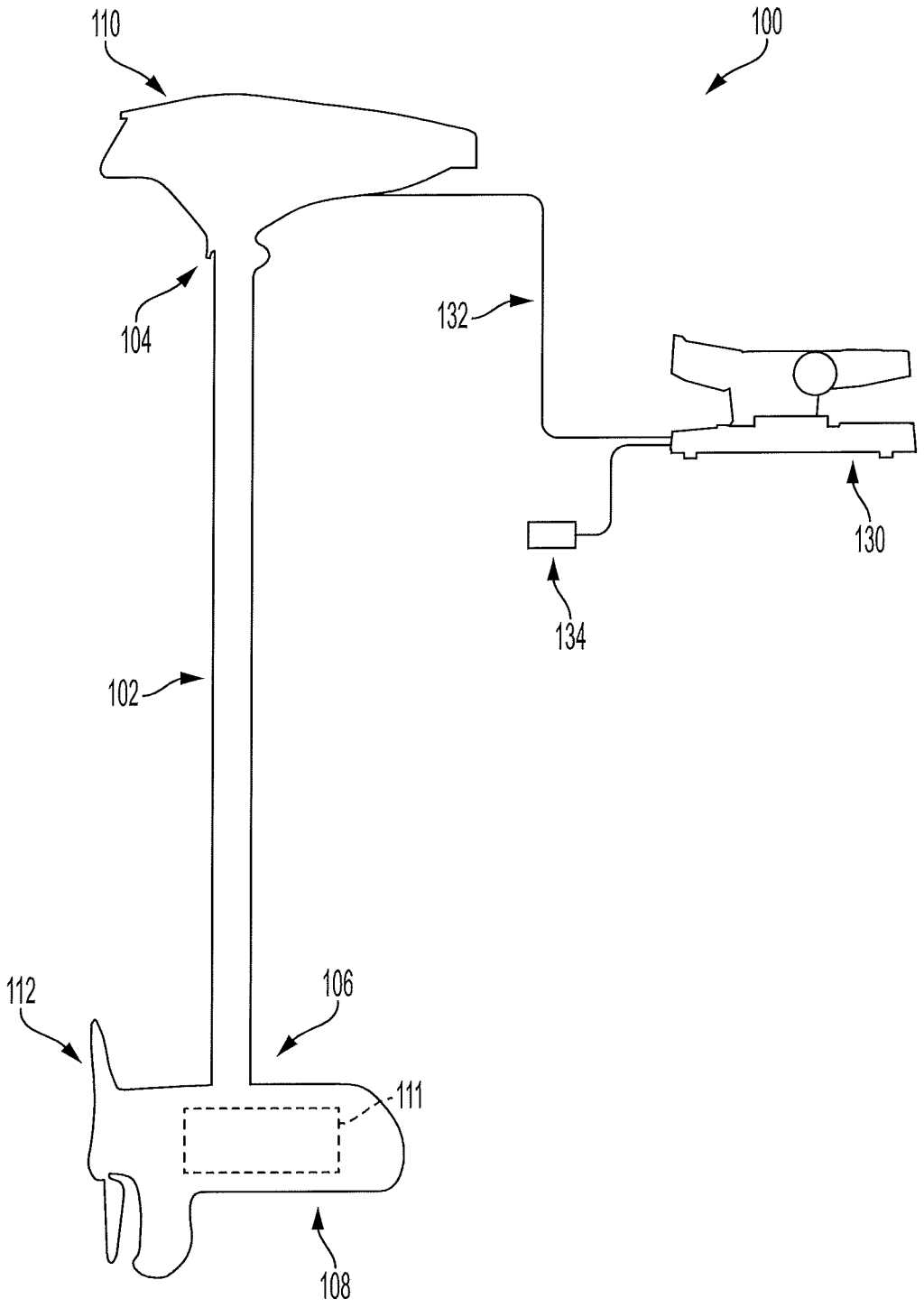
Figure 3:
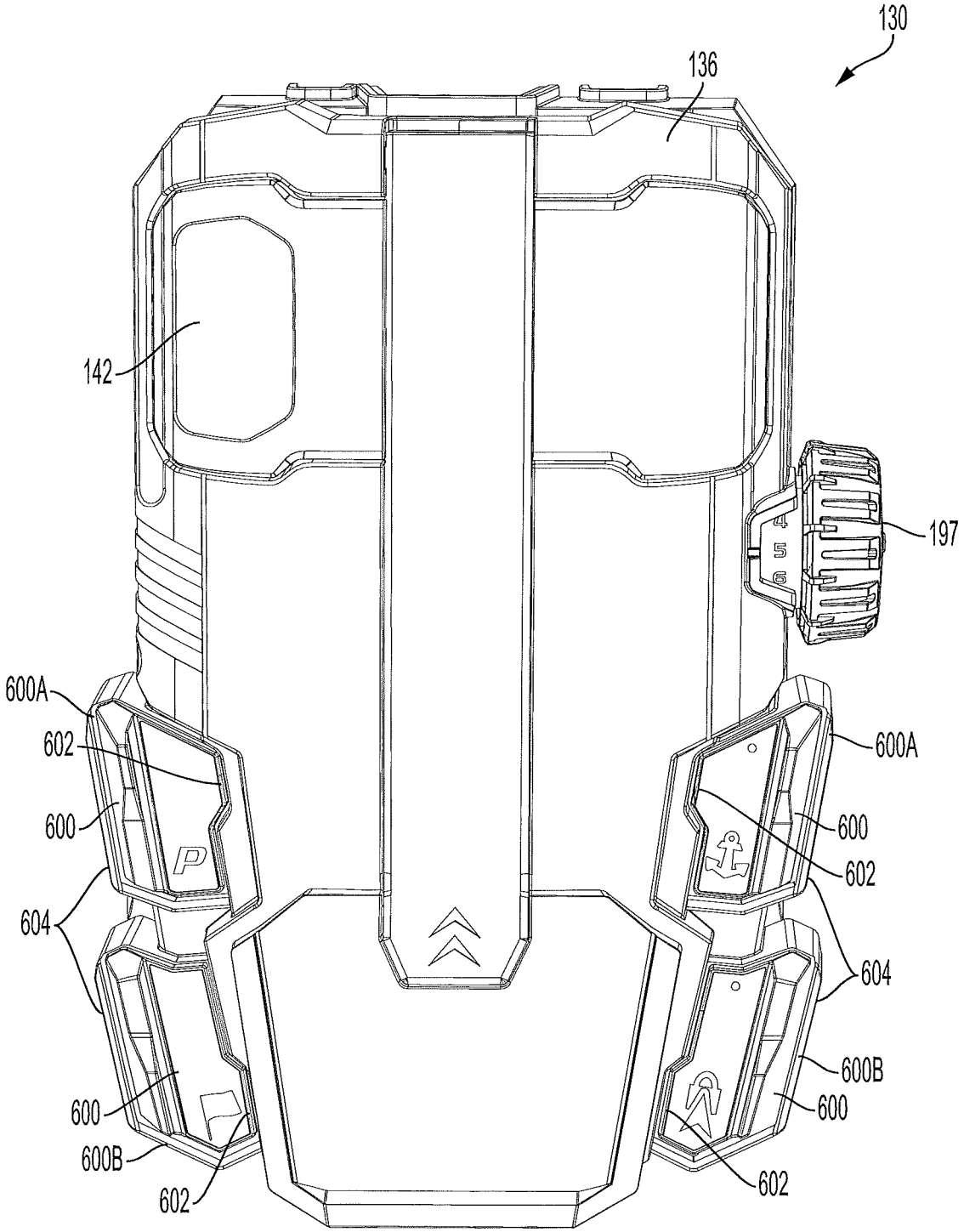
Figure 4:
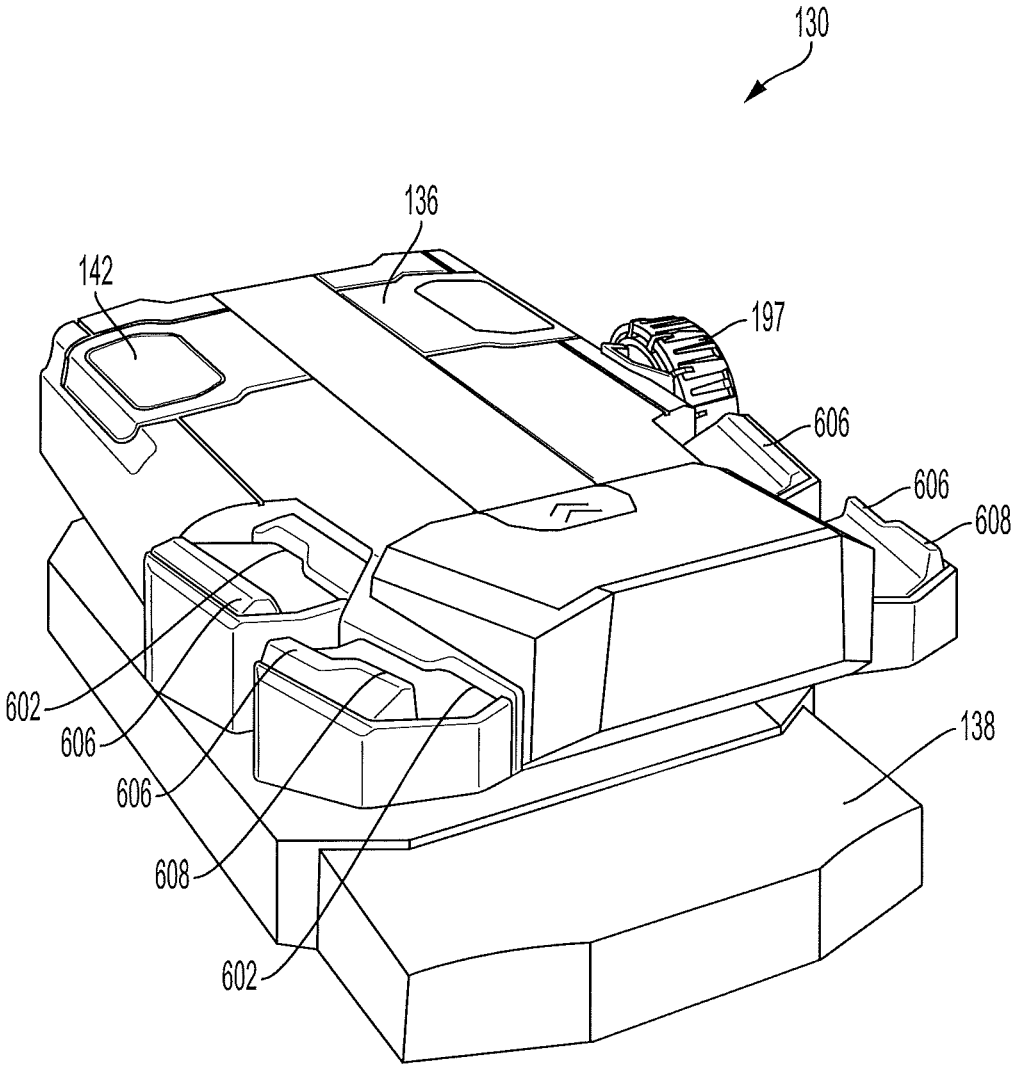
Figure 5:
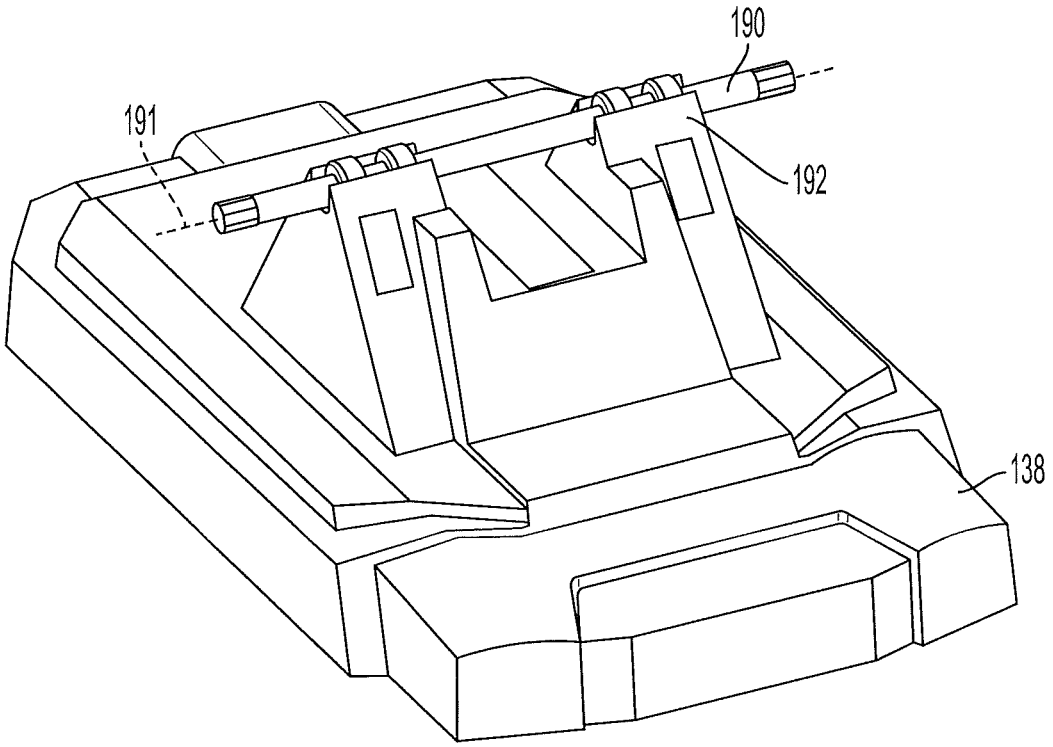
Figure 6:
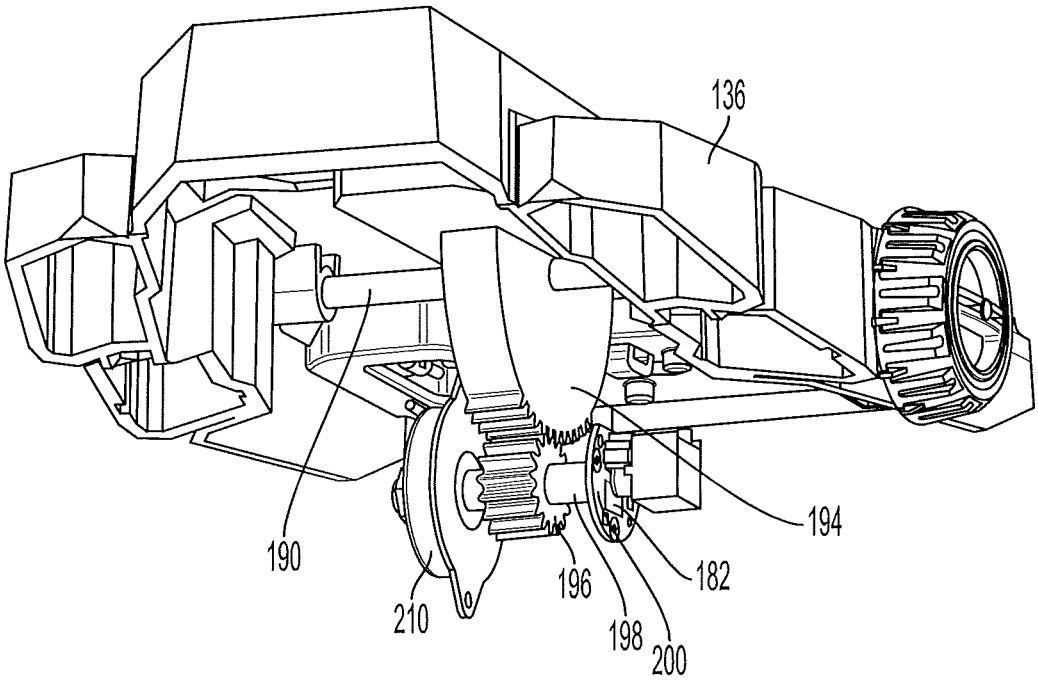
Figure 7:
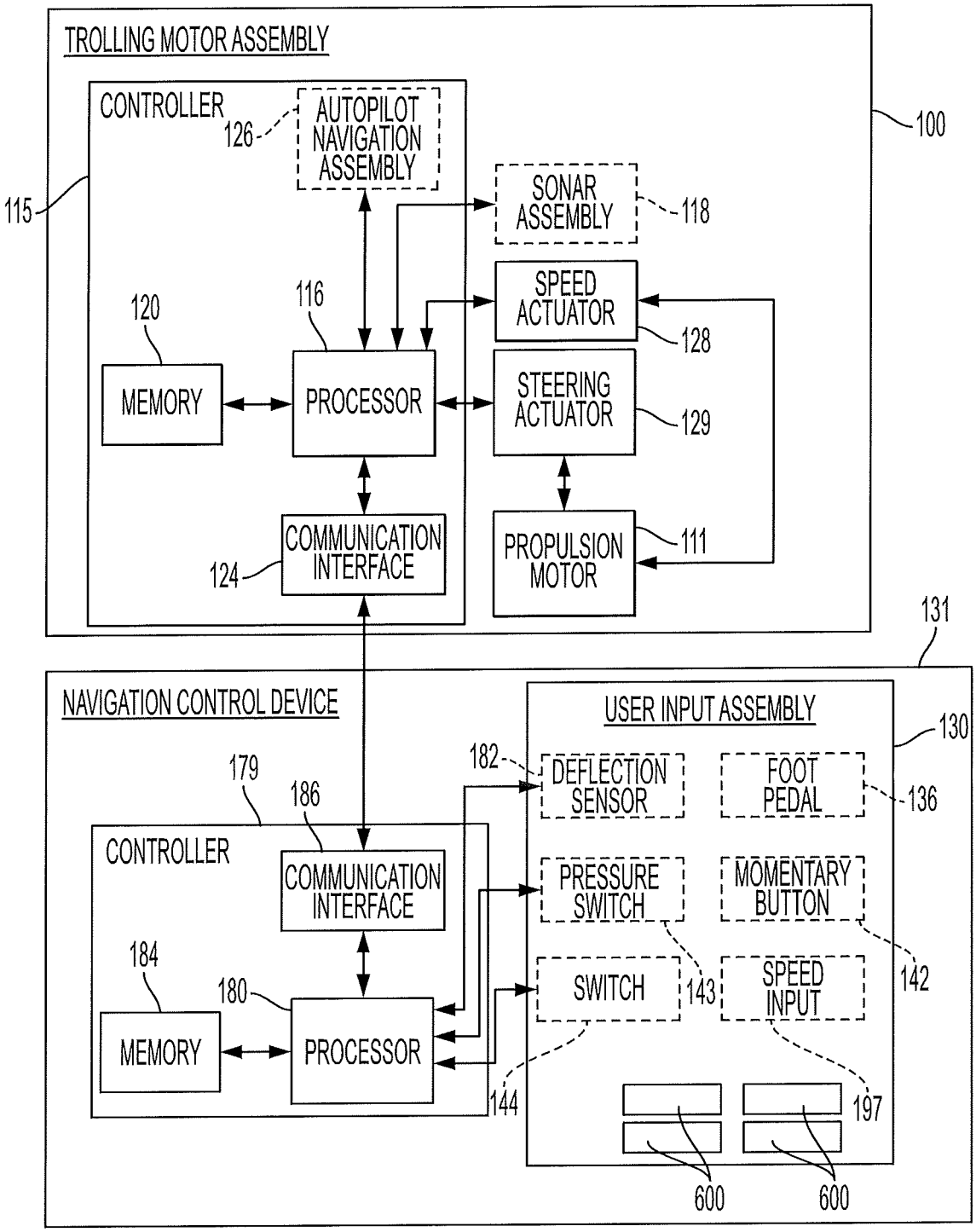
Figure 8:
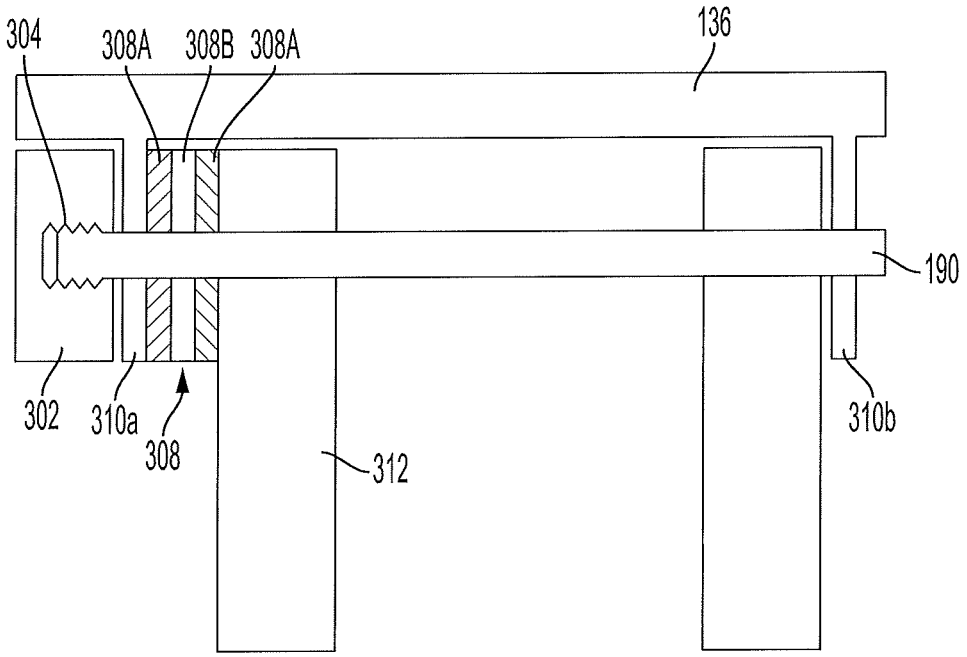
Figure 9:
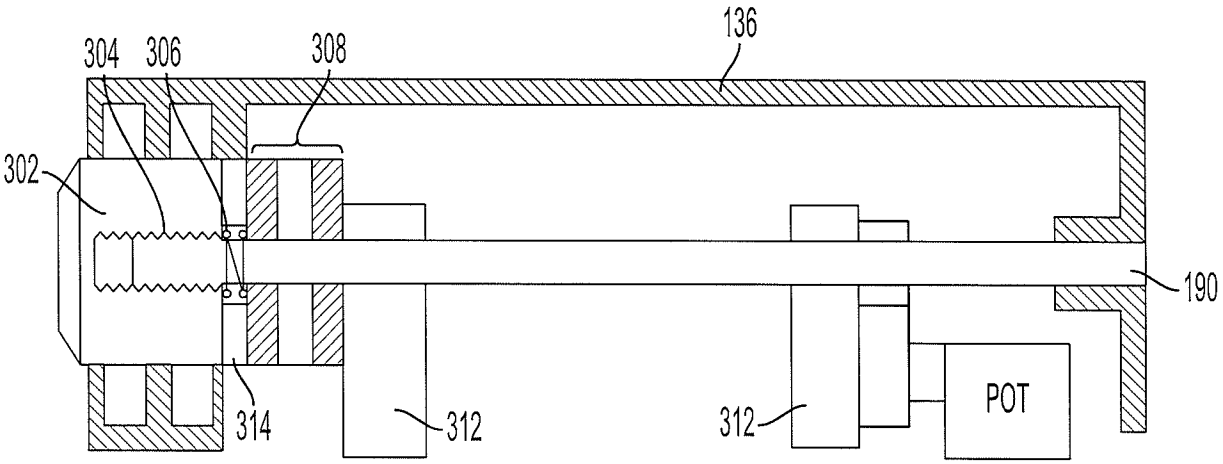
Figure 10:
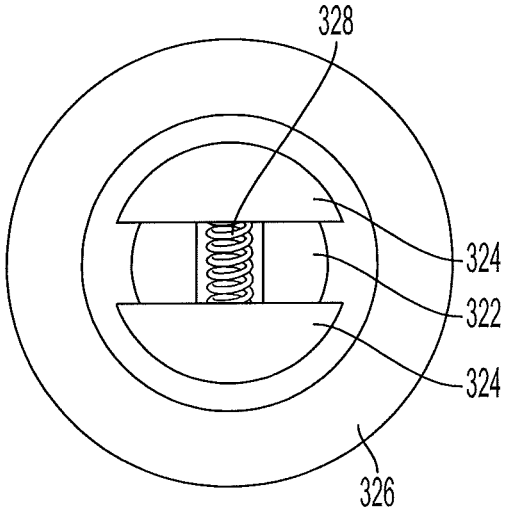
Figure 11:
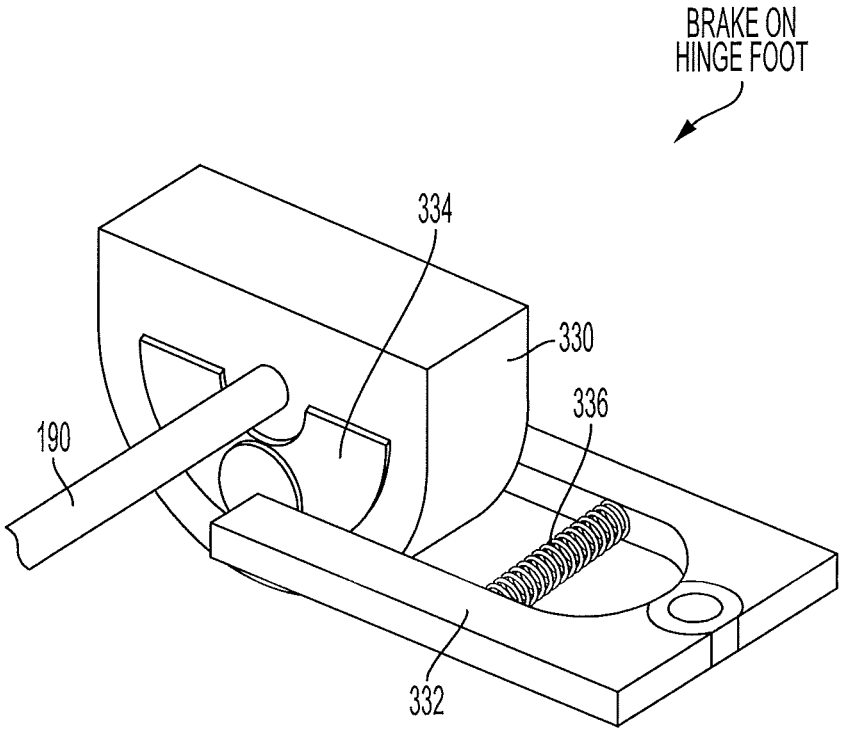
Figure 12:
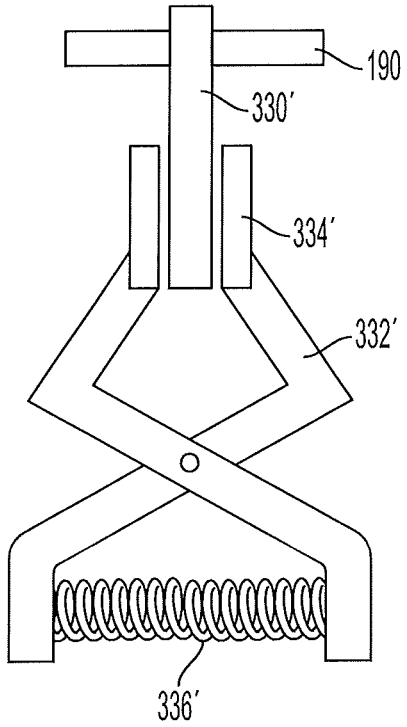
Figure 13:
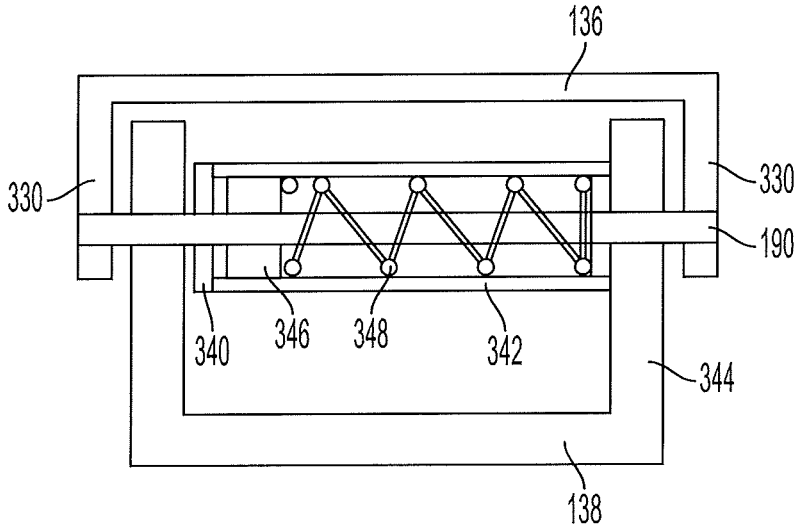
Figure 14:
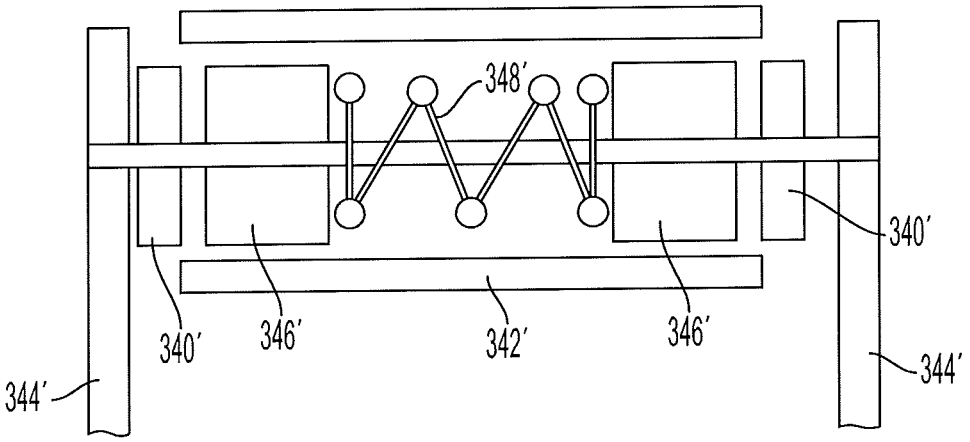
Figure 15:
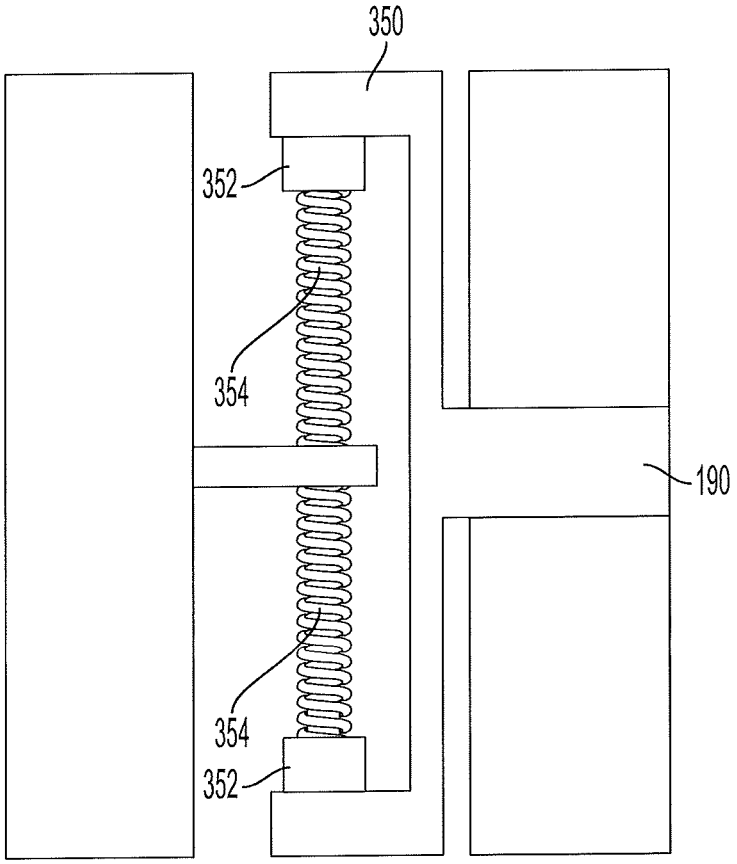
Figure 16:
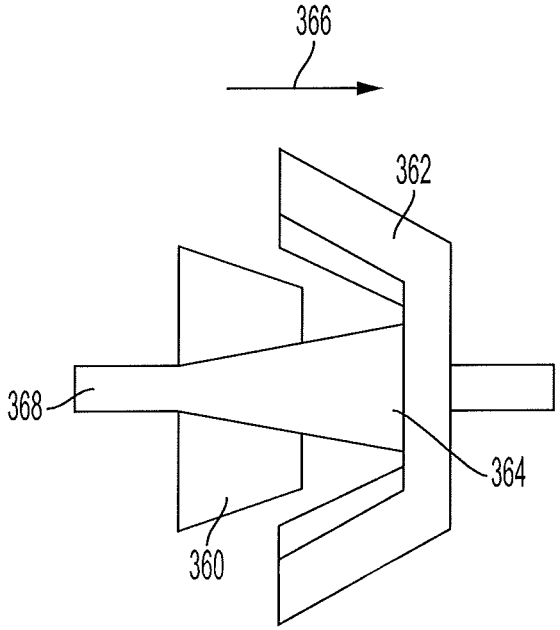
Figure 17:
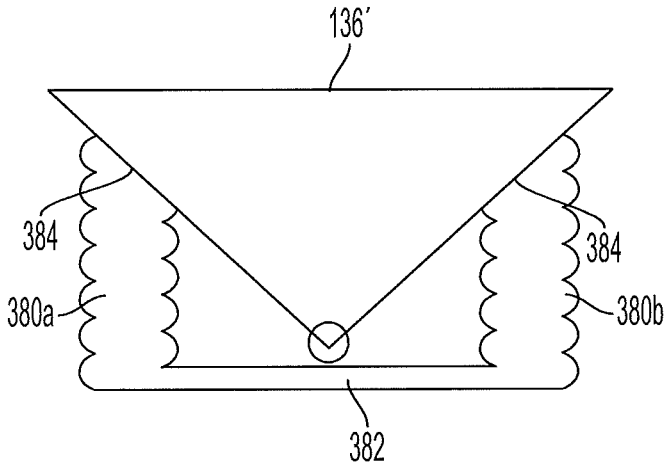
Figure 18:
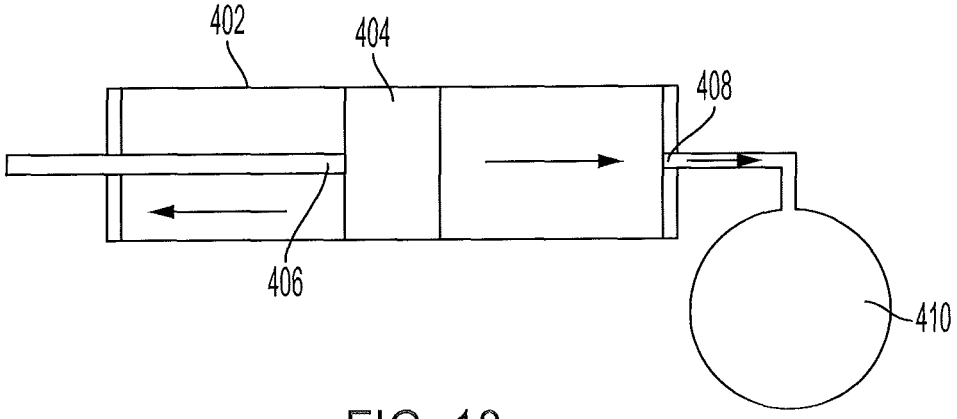
Figure 19:
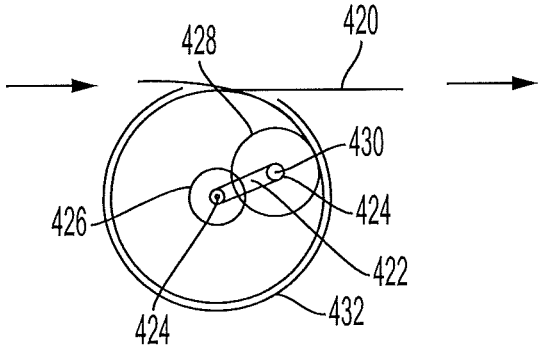
Figure 20:
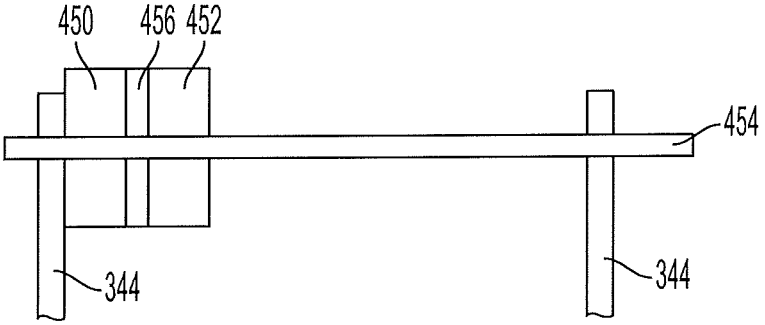
Figure 21:
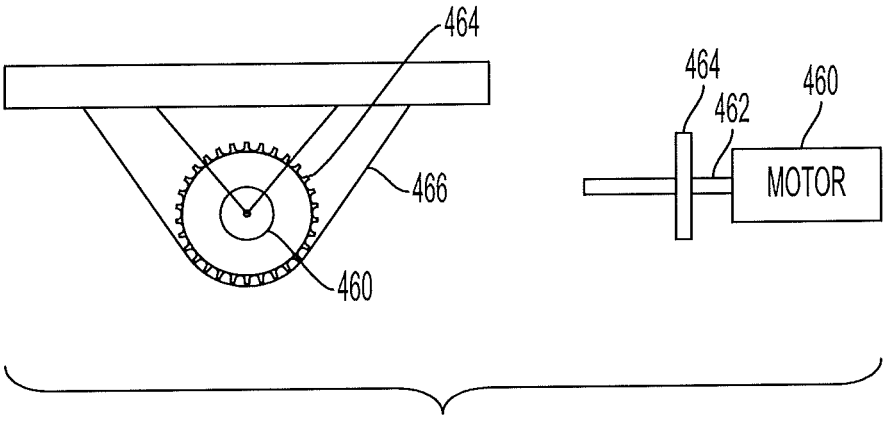
Figure 22:
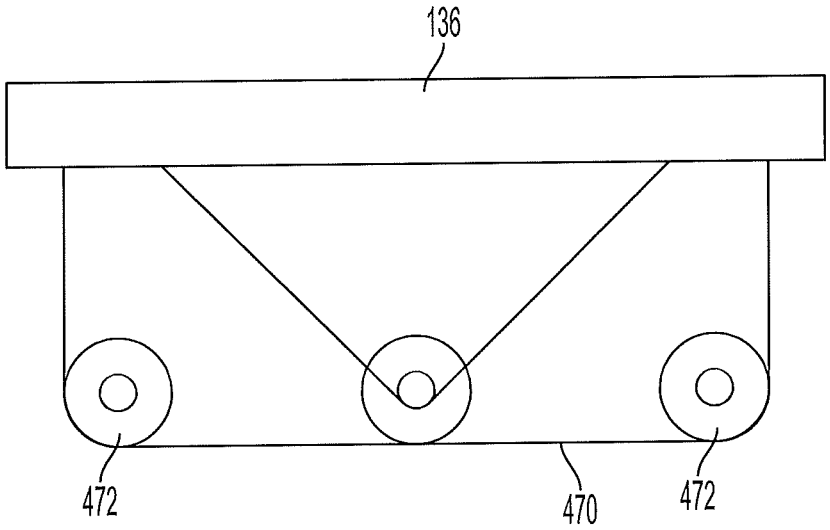
Figure 23:
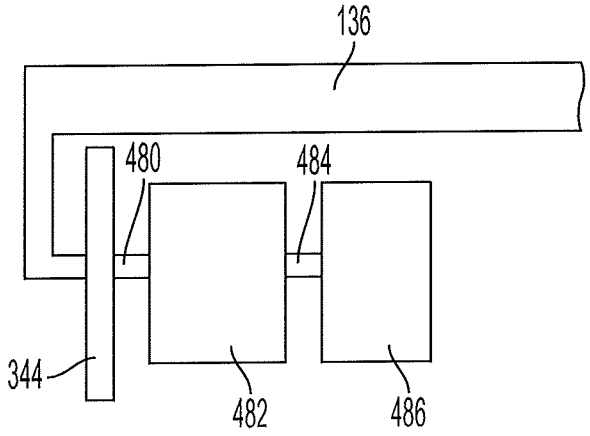
Figure 24A:
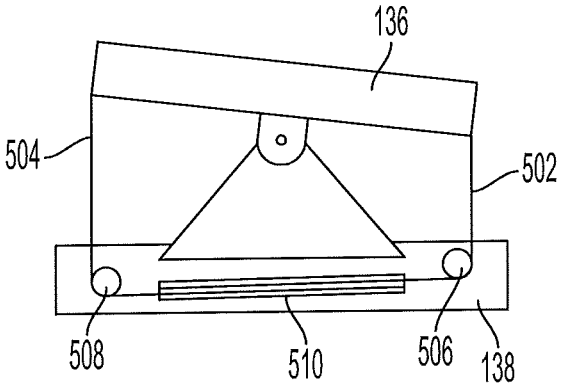
Figure 24B:
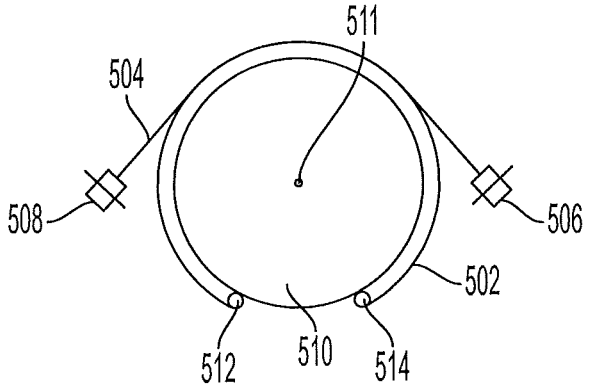
Figure 25:
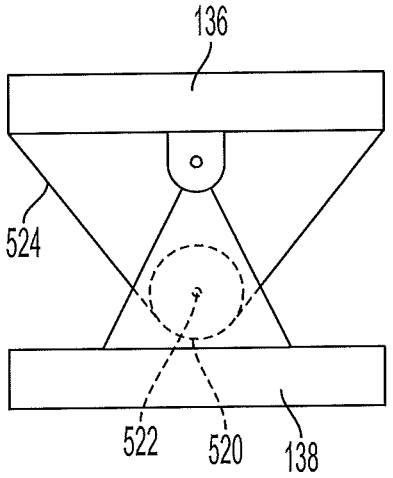
Figure 26:
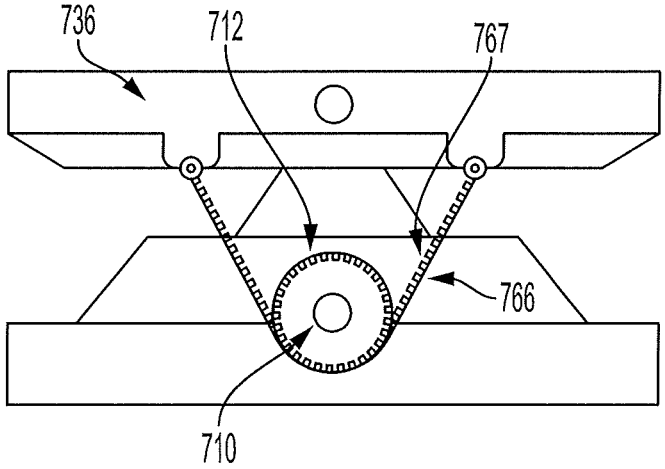

Having thus described the invention in general terms, reference will now be made to the accompanying drawings, which are not necessarily drawn to scale, and wherein:

FIG. 1 illustrates an example trolling motor assembly attached to a front of a watercraft, in accordance with some embodiments discussed herein;

FIG. 2 shows an example trolling motor assembly, in accordance with some embodiments discussed herein;

FIG. 3 shows a top view of an example foot pedal assembly, in accordance with some embodiments discussed herein;

FIG. 4 shows a perspective view of the example foot pedal assembly for a trolling motor assembly as shown in FIG. 3, in accordance with some embodiments discussed herein;

FIG. 5 shows a perspective view of an example support plate and shaft of the example foot pedal assembly shown in FIG. 4, in accordance with some embodiments discussed herein;

FIG. 6 shows an underside perspective view of an example foot pedal and second shaft of the example foot pedal assembly shown in FIGS. 3-4, in accordance with some embodiments discussed herein;

FIG. 7 shows a block diagram illustrating an example system of a trolling motor assembly and a navigation control device, in accordance with some embodiments discussed herein;

FIG. 8 illustrates a simplified cross section showing some components of an example foot pedal assembly having a drag washer for providing a feedback resistance to pivotal foot pedal movement, in accordance with some embodiments discussed herein;

FIG. 9 illustrates a simplified cross section showing some components of another example foot pedal assembly having a drag washer for providing a feedback resistance to pivotal foot pedal movement, in accordance with some embodiments discussed herein;

FIG. 10 illustrates a schematic of an example clutch brake for providing a feedback resistance to pivotal foot pedal movement, in accordance with some embodiments discussed herein;

FIG. 11 illustrates some components of an example brake assembly for providing a feedback resistance to pivotal foot pedal movement, in accordance with some embodiments discussed herein;

FIG. 12 illustrates some components of an alternative example brake assembly for providing a feedback resistance to pivotal foot pedal movement, in accordance with some embodiments discussed herein;

FIG. 13 illustrates a simplified cross section showing some components of an example foot pedal assembly having a brake pad for providing a feedback resistance to pivotal foot pedal movement, in accordance with some embodiments discussed herein;

FIG. 14 illustrates a simplified cross section showing some components of an example foot pedal assembly having a pair of brake pads for providing a feedback resistance to pivotal foot pedal movement, in accordance with some embodiments discussed herein;

FIG. 15 illustrates a simplified cross section of some components of an example drum brake assembly for providing a feedback resistance to pivotal foot pedal movement, in accordance with some embodiments discussed herein;

FIG. 16 illustrates a simplified cross section of some components of an example tapered brake assembly for providing a feedback resistance to pivotal foot pedal movement, in accordance with some embodiments discussed herein;

FIG. 17 illustrates a schematic of an example bellows brake assembly for providing a feedback resistance to pivotal foot pedal movement, in accordance with some embodiments discussed herein;

FIG. 18 illustrates a schematic of an example linear cylinder and piston for providing a feedback resistance to pivotal foot pedal movement, in accordance with some embodiments discussed herein;

FIG. 19 illustrates a schematic of an example peristaltic pump for providing a feedback resistance to pivotal foot pedal movement, in accordance with some embodiments discussed herein;

FIG. 20 illustrates a simplified cross section of some components of an example magnetic brake assembly for providing a feedback resistance to pivotal foot pedal movement, in accordance with some embodiments discussed herein;

FIG. 21 illustrates a schematic of an example motor assembly for providing a feedback resistance to pivotal foot pedal movement, in accordance with some embodiments discussed herein;

FIG. 22 illustrates a schematic of an example foot pedal coupled with a friction pulley assembly for providing a feedback resistance to pivotal foot pedal movement, in accordance with some embodiments discussed herein;

FIG. 23 illustrates a schematic of an example flywheel assembly for providing a feedback resistance to pivotal foot pedal movement, in accordance with some embodiments discussed herein;

FIGS. 24A-B illustrate a schematic of another example flywheel assembly for providing a feedback resistance to pivotal foot pedal movement, in accordance with some embodiments discussed herein;

FIG. 25 illustrates a schematic of another example flywheel assembly for providing a feedback resistance to pivotal foot pedal movement, in accordance with some embodiments discussed herein; and FIG. 26 illustrates a schematic of another example feedback device, in accordance with some embodiments discussed herein.

DETAILED DESCRIPTION

Exemplary embodiments of the present invention now will be described more fully hereinafter with reference to the accompanying drawings, in which some, but not all, embodiments of the invention are shown. Indeed, the invention may be embodied in many different forms and should not be construed as limited to the exemplary embodiments set forth herein. Rather, these embodiments are provided so that this disclosure will satisfy applicable legal requirements. Like reference numerals refer to like elements throughout.

FIG. 1 illustrates an example watercraft 10 on a body of water 15. The watercraft 10 has a trolling motor assembly 20 attached to its front, with a propulsion motor 50 submerged in the body of water. According to some example embodiments, the trolling motor assembly 20 may include the propulsion motor 50, a propeller 52, and a navigation control device used to control the speed and the course or direction of propulsion. The trolling motor assembly 20 may be attached to the bow of the watercraft 10 and the propulsion motor 50 and propeller 52 may be submerged in the body of water. However, positioning of the trolling motor assembly 20 need not be limited to the bow and may be placed elsewhere on the watercraft 10. The trolling motor assembly 20 can be used to propel the watercraft 10, such as when fishing and/or when wanting to remain in a particular location despite the effects of wind and currents on the watercraft 10. Depending on the design, the propeller 52 of a trolling motor assembly may be driven by a gas-powered engine or an electric motor. Moreover, steering the trolling motor assembly 20 may be accomplished manually via hand control or via foot control or electronically using a remote and/or foot pedal. While FIG. 1 depicts the trolling motor assembly 20 as being a secondary propulsion system to the main engine 11, example embodiments described herein contemplate that the trolling motor assembly 20 may be the primary propulsion system for the watercraft 10.

FIG. 2 illustrates an example trolling motor assembly 100 that is electric and may be controlled with a foot pedal assembly 130. The trolling motor assembly 100 includes a shaft 102 defining a first end 104 and a second end 106, a trolling motor housing 108 and a main housing 110. The trolling motor housing 108 is attached to the second end 106 of the shaft 102 and at least partially contains a propulsion motor 111, or trolling motor, that connects to a propeller 112. As shown in FIG. 1, in some embodiments, when the trolling motor assembly is attached to the watercraft 10 and the propulsion motor 111 (or trolling motor housing) is submerged in the water, the propulsion motor is configured to propel the watercraft to travel along the body of water. In addition to containing the propulsion motor 111, the trolling motor housing 108 may include other components such as, for example, a sonar transducer assembly and/or other sensors or features (e.g., lights, temperature sensors, etc.).

The main housing 110 is connected to the shaft 102 proximate the first end 104 of the shaft 102 and may, in some embodiments, include a hand control rod (not shown) that enables control of the propulsion motor 111 by a user (e.g., through angular rotation) although the foot pedal assembly 130 is the preferred method of controlling the operation of the trolling motor assembly 100 for various embodiments described herein. As shown in FIG. 1, in some embodiments, when the trolling motor assembly is attached to the watercraft and the propulsion motor 111 is submerged in the water, the main housing 110 is positioned out of the body of water and visible/accessible to a user. The main housing 110 may be configured to house components of the trolling motor assembly, such as may be used for processing marine data and/or controlling operation of the trolling motor, among other things. For example, with reference to FIG. 7, depending on the configuration and features of the trolling motor assembly, the trolling motor assembly 100 may contain, for example, one or more of a processor 116, sonar assembly 118, memory 120, communication interface 124, an autopilot navigation assembly 126, a speed actuator 128, and a steering actuator 129 for the propulsion motor 111. In some embodiments, a controller 115 may comprise the processor 116, memory 120, communications interface 124, and the autopilot navigation assembly 126.

Referring back to FIG. 2, as noted, in some embodiments, the trolling motor assembly 100 includes a foot pedal assembly 130 that is electrically connected to the propulsion motor 111 (such as through the main housing 110) using a cable 132 (although wireless communication is also contemplated). Referring also to FIG. 7, the foot pedal assembly 130 may enable a user to steer and/or otherwise operate the trolling motor assembly 100 to control the direction and speed of travel of the watercraft. Further, depending on the configuration of the foot pedal assembly, the foot pedal assembly 130 may include an electrical plug 134 that can be connected to an external power source.

The trolling motor assembly 100 may also include an attachment device (e.g., a clamp, a mount, or a plurality of fasteners) to enable connection or attachment of the trolling motor assembly 100 to the watercraft. Depending on the attachment device used, the trolling motor assembly 100 may be configured for rotational movement relative to the watercraft, including, for example, 360 degree rotational movement.

FIGS. 3 through 6 show an example implementation of a user input assembly of a navigation control device according to various example embodiments in the form of a foot pedal assembly 130. The foot pedal assembly 130 may be one example of a user input assembly that, in some embodiments, includes a switch in the form of a pressure sensor 143 (FIG. 7) operated by a depressable momentary button 142 and/or a pivotable foot pedal 136 (although in some embodiments, there may be no pressure sensor within the foot pedal assembly). In further embodiments, the foot pedal assembly may include buttons 600 that depend from the pedal adjacent the pedal's upper surface.

The foot pedal assembly 130 may be in operable communication with the trolling motor assembly 100 (FIG. 2), via, for example, the processor 180 as described with respect to FIG. 7. The foot pedal assembly 130 includes a lever in the form of the foot pedal 136 that can pivot about a horizontal axis in response to movement of, for example, a user's foot. The foot pedal assembly 130 further includes a support plate 138 and a deflection sensor 182 (see also FIG. 7). As described herein, the deflection sensor 182 may measure the deflection of the foot pedal 136 and provide an indication of the deflection to, for example, the processor 180. Such deflection may be used to control the rotation of the trolling motor shaft (e.g., the direction/orientation of the trolling motor) and, in some embodiments, in conjunction with a feedback device that provides resistance feedback to a user to simulate a reactionary force to a user utilizing the foot pedal.

In some embodiments, a speed input device 197 (e.g., the dial 197 shown in FIG. 3) may be provided to enable a user to set the speed at which the trolling motor propels the boat. Based on the setting of the speed input device, a corresponding speed signal may be provided to the speed actuator 128 via a wired or wireless connection.

In some embodiments, the foot pedal assembly may include a momentary switch 144 (FIG. 7) that may, in some embodiments, form an ON/OFF button to selectively provide power to the foot pedal assembly 130.

Referring to FIG. 5, the foot pedal 136 may be rotationally fixed to a first shaft 190 so that the rotation of the pedal causes corresponding rotation of the first shaft about an axis 191. As used herein, "rotationally fixed" refers to a coupling in which rotationally fixed components pivot about the same axis and for the same angular displacement. The first shaft 190 may pivot within housings 192 of support plate 138. A first gear 194 is keyed to the shaft 190 so that it is rotationally fixed with the shaft, and therefore, the foot pedal 136. Teeth of the first gear 194 engage a second gear 196 that is rotationally fixed to a second shaft 198. Accordingly, as the pedal pivots, it causes the second shaft 198, via the first and second gears 194, 196, to rotate.

Some embodiments of the present invention include a deflection sensor for determining the angle of orientation/deflection of the foot pedal. In the depicted embodiment of FIG. 6, a magnet (not shown) may be disposed within a first end of shaft 198 that is adjacent the deflection sensor 182, which may be, for example, a Hall effect sensor. Such an example deflection sensor 182 may continuously detect the orientation of the magnet, and, thus, the orientation of the shaft 198, which corresponds with the pedal's deflection angle. In further embodiments, the shaft 198 physically and rotationally couples with the deflection sensor 182, which may be, for example, a Hall effect sensor, a potentiometer, a RVDT sensor, an inductive position sensor, or a rotary encoder. In yet further embodiments, the deflection sensor may directly measure the deflection angle of the first shaft 190, rather than indirectly measuring the deflection angle by measuring the deflection of a second shaft that is coupled with the first shaft and correlating the second shaft's angle with the first shaft's angle.

In the illustrated embodiment, the first gear 194 has a larger diameter than the second gear 196, thereby providing a gear ratio that is greater than 1:1. The gear ratio of the first gear 194 to the second gear 196 may be selected in order to optimize the resolution of the deflection sensor. That is, because of said gear ratio, small changes in pedal deflection angle correspond to large changes in the second shaft's deflection angle, which may utilize a greater span of the deflection sensor's sensing range than a lower gear ratio.

Referring also to FIG. 7, according to some example embodiments, the measured deflection of the foot pedal 136 may be an indication of a desired propulsion direction for the propulsion motor. In this regard, a user may cause the foot pedal 136 to rotate or deflect; and rotation of the foot pedal 136 in the counterclockwise direction (such that the left side of the illustrated foot pedal in FIG. 2 is tilted down) may cause the propulsion direction to turn to the left while rotation of the foot pedal 136 in the clockwise direction (such that the right side of the illustrated foot pedal in FIG. 2 is tilted down) may cause the propulsion direction to turn to the right. The deflection sensor 182, which may be attached to a printed circuit board 200, may provide a signal corresponding with a deflection angle to a controller 179 (which may include the processor 180, the memory 184, and the communications interface 186). As further discussed herein, the detected foot pedal deflection angle may cause the trolling motor's steering actuator 129 to pivot about the shaft 102, thereby causing the propeller 112 (FIG. 2), if ON, to propel the watercraft in a desired direction. That is, a motor (e.g., a stepper motor) may cause the shaft 102 to pivot about its axis in order to position the propeller 112 in a desired orientation that a user sets via the foot pedal deflection angle.

Some embodiments of the present invention provide a foot pedal assembly configured for electrically and remotely controlling a trolling motor assembly. In traditional pedal-steered trolling motors, pivoting of the pedal manually pivots the trolling motor via a direct cable connection. Such cable-steered trolling motors provide a feedback resistance "feel" that may be preferable for some users. Accordingly, it may be desirable to provide electrically steered motors having a foot pedal resistance that simulates resistance of mechanically moving the trolling motor. Some embodiments disclosed herein implement systems for providing such a feedback resistance. For example, the foot pedal may include various features, such as, but not limited to, flywheels, brakes, and various other elements that resist rotational acceleration of the pedal as it pivots about its axis.

In the illustrated embodiment of FIG. 6, a rotary damper 210 couples with the second shaft 198 at a second end, opposite the first end. The rotary damper 210 may resist rotational motion. Accordingly, the second gear 196 may act as a damper gear that resists motion of the shaft 198, and, accordingly, all other components mechanically and rotationally coupled thereto, including the pedal 136. In some embodiments, the damper resists rotational motion as a function of its angular speed. For example, the rotary damper 210 may provide a resistive force that is proportional to the rate at which the foot pedal pivots. Because of the gear ratio between first gear 194 and second gear 196, an angular speed of the pedal 136 causes an angular speed of the damper gear that is higher than that of the pedal 136. For this reason, when using a damper that increases resistance with angular speed, the second gear's stepped-up pivotal movement provides a corresponding increased resistance to the angular speed of the pedal. In other embodiments, the damper's resistive torque is constant across a range of angular speeds. In some embodiments, the resistive torque remains consistent for a given angular speed. Further, in some embodiments, the resistive torque remains consistent for a given angular speed over a number of cycles. Alternatively, in some embodiments, the resistive force may remain consistent over the life of the product.

FIGS. 8-25 illustrate various other example embodiments for providing resistive feedback to changes in the foot pedal's angular position. In this regard, some of the example embodiments provide feedback devices that simulate the resistance of a traditional trolling motor pedal that moves the trolling motor via mechanical cables.

Referring to FIG. 8, the pedal 136 may couple with the shaft 190 via feet 310*a*, 310*b* so that the foot pedal is rotationally fixed to the shaft. A drag washer 308 may be disposed between a first shaft housing 312, which is rigidly coupled to the support plate 138, and one foot 310*a* of the pedal 136. A nut 302 may be tightened down on threads 304 of the first shaft 190, thereby compressing the drag washer 308 between the foot 310*a* of the pedal 136 and the first shaft housing 312. The first shaft housing 312 may, in some embodiments, be the same as, or similar to, the housings 192 as shown in FIG. 5. Drag washer 308 may comprise a fiber washer 308B disposed between two metal washers 308A. As the nut 302 is tightened down, the drag washer is compressed between the foot 310*a* and the first shaft housing 312. Because the foot 310*a* of the pedal 136 pivots as the pedal pivots, while the first shaft housing 312 does not, respective pivotal movement between the pedal and the housing creates friction at the interfaces between all of the respective components. Specifically, the fiber and metal layers may be selected to provide desired interfaces that cause a lower static frictional force than interfaces between other material interfaces (e.g., the interface between the washer 308 and the foot 310*a* of the pedal 136 and the interface between the washer 308 and the first shaft housing 312 of the support plate 138). In this way, sliding may occur only at interfaces between the fiber and metal washers in response to pivotal movement of the pedal. Nut 302 may be adjusted to change the force on the drag washers, thereby adjusting the frictional resistive torque.

Referring to FIG. 9, another example embodiment implementing drag washers is shown. A spring 306 is disposed between the nut 302 and the drag washer 308 and within a hollow cylindrical spacer 314. As the nut 302 is tightened down, the spring 306 increases its compressive force, thereby compressing the drag washer 308. Accordingly, the drag washer resistively allows pivoting between the spring 306 and the first shaft housing 312.

Referring to FIG. 10, a clutch brake may be implemented to resist the foot pedal's rotational movement. In some embodiments, a pair of brake shoes 324 may be affixed to a shaft 322 so that the brake shoes may move radially from the shaft's axis. Rotation of the shaft 322 causes a centrifugal force on the brake shoes, thereby forcing them radially outward from the shaft's axis and against a drum 326. The drum 326 may be fixed to the support plate 138 (FIG. 3) so that it does not pivot. Accordingly, as the brake shoes 324 engage the drum, the frictional force between the respective components resists the rotation of the brake shoes 324 and, thus, the shaft 322. An increase in angular velocity corresponds with an increase in centrifugal force and, therefore, an increased frictional force, thereby causing an increasing resistive force as the angular velocity of the shaft 322 increases. The shaft 322 may be coupled to the first shaft 190 (FIG. 5) by a gear train so that a small angle of rotation of the shaft 190 causes a relatively larger angle of rotation of the shaft 322, thereby corresponding with faster rotation of the shaft 322 than the first shaft 190.

FIGS. 11-12 illustrate alternative example embodiments of a foot pedal having a brake to resist the pedal's pivotal movement. The foot pedal 136 (FIG. 3) may include a pair of feet 330, 330' (one foot shown) that engage the shaft 190 (FIG. 5), a similar embodiment of which is described with reference to FIG. 8. A caliper 332, 332' may hold a pair of brake pads 334, 334' against one foot 330, 330' of pedal 136. A spring 336, 336' may provide tension on the caliper to bias the brake pads 334, 334' against the foot 330, 330'. The caliper 332, 332' may be fixed to the support plate 138 (FIG. 3) so that as the pedal and, accordingly, the foot 330, 330', pivot about the shaft's axis, the brake pads slide against side faces of the foot 330, 330', thereby resisting pivotal movement of the pedal.

Referring to FIG. 13, the foot pedal assembly may include a brake pad 340 that slides along the axis of the shaft 190 adjacent a hollow cylindrical housing 342. The support plate 138 may include a pair of housings 344 that support the shaft 190. A spacer 346 is slidably disposed at one end of a spring 348 within the housing 342 and biases against the brake pad 340 so that the brake pad 340 biases against one of housings 344. Foot pedal 136 is rotationally fixed to shaft 190 at feet 330, and brake pad 340 is rotationally fixed to the shaft 190. Accordingly, rotation of the pedal causes rotation of the brake pad 340, yet the housing 344 is stationary, thereby causing sliding friction at the interface between the brake pad 340 and the housing 344.

FIG. 14 illustrates a similar embodiment as in that of FIG. 13 but utilizes two brake pads 340'. The spring 348' biases against two opposing spacers 346' that, in turn, bias against respective brake pads 340'. The brake pads 340' engage respective housings 344' to resist rotation between the pedal 136 (FIG. 4) and the support plate 138 (FIG. 5).

FIG. 15 illustrates an example drum brake that may be implemented to resist respective rotation between the pedal and the support plate. A brake drum 350 may be rotationally fixed to the shaft 190. A pair of drum shoes 352 may be fixed to the support plate 138 (FIG. 5) and bias under respective spring force of springs 354 against the brake drum 350 to resist respective rotation between the foot pedal and the support plate.

Referring to FIG. 16, an example tapered acceleration drum brake may be implemented to resist respective rotation between the pedal and the support plate. A tapered brake shoe 360 is rotationally fixed to the shaft 368. As the angular speed of the shaft increases, the tapered brake shoe 360 undergoes a centrifugal force. The shaft 368 includes a tapered end 364 that increases in diameter in an axial direction 366. Accordingly, a centripetal force causes the tapered brake shoe 360 to slide axially along the shaft 368 in the direction 366 toward a tapered drum 362. The tapered drum 362 is fixed with respect to the support plate (FIG. 5), and engagement with the tapered brake shoe 360 causes a frictional force that resists movement of the brake shoe, and therefore, the shaft's motion. In this way, an increasing angular shaft speed causes a correspondingly increasing force between the tapered brake shoe 360 and the tapered drum 362, thereby providing an increasing resistive feedback. In some embodiments, the shaft 368 may be connected to the shaft 190 (FIG. 5) via a gear train that causes a greater angular speed in the shaft 368 than that of the shaft 190.

Referring to FIG. 17, in some embodiments, a pedal 136' may include a pair of flexible, fluid-filled baffles 380*a*, 380*b* connected by a restricted pathway 382. In some embodiments, the baffles 380*a*, 380*b* may be filled with a viscous fluid. In further embodiments, the baffles may be filled with air. The pedal may have surfaces 384 that engage respective baffles 380. As the pedal pivots, one of the engagement surfaces 384 may press against its respective baffle 380*a*, thereby compressing the baffle and increasing pressure in its volume. Accordingly, this pressure increase causes the fluid to flow through the restricted pathway 382 and into the other baffle 380*b*. The restricted pathway 382 resists such fluid movement and, therefore, resists pivotal motion of pedal 136' about its pivotal axis.

Referring to FIG. 18, some example embodiments of a foot pedal assembly in accordance with the present disclosure may include a linear cylinder 402 (which may be pneumatic or hydraulic) that has a piston 404 therein. The piston 404 may connect to a shaft 406. The shaft may connect to one of the foot pedal 138 (FIG. 3) or the support plate 138 (FIG. 3), and the cylinder 402 may connect to the other of the foot pedal or the support plate. At least one of the cylinder and the shaft may connect via a rotational to linear motion mechanism, such as, for example, a slider coupled with a crank. In this way, as the foot pedal pivots with respect to the support plate, the shaft 406 drives the piston 404 linearly within the cylinder 402. The cylinder may include an orifice 408 through which air or hydraulic fluid may pass. The orifice 408 may be of a select size so that movement of the piston provides a desired resistance. Some embodiments may further include a reservoir 410 outside the piston into and from which hydraulic fluid may be pumped.

Referring to FIG. 19, some embodiments of a foot pedal assembly in accordance with the present disclosure may include a peristaltic pump for resisting pivotal motion of the foot pedal. The peristaltic pump may include a tubing 420 full of a viscous liquid and that is forming in a loop in a housing 432. The pump may include a crank arm 422 driven about an axis 424. The crank arm may, for example, rigidly connect to a shaft 426. The foot pedal 136 (FIG. 3) may drive the shaft 426 via a gear train that is configured so that the shaft 426 rotates faster than the pedal pivots about its axis. A pivoting wheel 428 may pivot about an end of the crank arm 422 opposite the shaft 424 about an axis 430. As the wheel 428 rotates, it pinches the tubing 420 against the housing 432, thereby displacing fluid in the tubing in the direction in which the crank atm 422 rotates. The liquid's viscosity resists such flow, thereby resisting movement of the crank arm 422, and, consequently, via the mechanical couplings, the foot pedal.

Referring to FIG. 20, some embodiments of a foot pedal assembly may include a magnetic brake for resisting pivotal motion of the foot pedal. A magnet 450 may be fixed to one of a pair of housings 344 that support a shaft 454 so that the magnet does not rotate. A steel plate 452 may be positioned proximate the magnet and rotationally fixed to the shaft 454. A PTFE washer 456 may be disposed between the magnet 450 and the steel plate 452. The foot pedal may be coupled with the shaft 454 so that, when the foot pedal pivots, the shaft rotates. In some embodiments, the foot pedal couples with the shaft 454 via a gear train that causes the shaft 454 to rotate proportionally faster than the pedal. As the pedal pivots, the shaft and steel plate correspondingly rotate. Because of the respective movement between the steel plate and the magnet, the magnet causes eddy currents that create a magnetic field opposite the magnet's magnetic field, thereby resisting the direction of motion of the steel plate and shaft. Accordingly, the steel plate and magnet act as a magnetic brake.

Referring to FIG. 21, the foot pedal assembly may include a motor 460 that drives a shaft 462 having a sprocket 464 keyed thereto so that the sprocket and shaft are rotationally fixed. The pedal 136 may couple at each end with a chain 466 that runs along the sprocket 464 so that as the pedal turns, the sprocket turns. A controller (not shown) may detect motion of the pedal. In response thereto, the controller may provide a signal to the motor that causes the motor to provide a torque in a direction opposite the sprocket's pivotal direction.

Referring to FIG. 22, another example feedback device is shown. In the depicted embodiment, the ends of the pedal 136 may be coupled with a cable 470. The cable drives at least one friction wheel 472. The friction wheels may resist rotation, thereby resisting movement of cable 470 and, therefore, pedal 136.

In some embodiments, the foot pedal may couple with a flywheel, such that the flywheel may provide resistance force. FIG. 23 illustrates an example flywheel-based feedback device. In the depicted embodiment, the pedal 136 may be rotationally fixed, via a shaft 480, to a gear in a gear train, such as, for example, a planetary gear train 482. The planetary gear train 482 may step up the angular speed to an output shaft 484 that, in turn, drives a flywheel 486. Because the flywheel, when spinning, has angular inertia, the illustrated embodiment may also provide a foot pedal that resists deceleration of its angular rotation.

Referring to FIGS. 24A and 24B, another example flywheel-based feedback device is shown. In the depicted embodiment, the pedal 136 may turn a flywheel via a cable 502 and a cable 504. The cables 502, 504 may attach at respective heel and toe ends of pedal 136. The cables 502, 504 may be redirected around free spinning pulleys 506, 508, respectively, and wrap around pulley flywheel 510, which has a vertically oriented axis 511 that is perpendicular to the pedal's pivot axis. Free spinning pulleys 506, 508 may rotate about a horizontal axis. Free spinning pulleys 506, 508 may be attached to the support plate 138 and angled in an orientation so that the cables are directed to tangents of the flywheel 510. In this way, the cables 502, 504 are directed toward proper engagement with flywheel 510. The cables 502, 504 attach to the flywheel at attachment points 512, 514, respectively. As a user presses down on the heel end of the pedal, cable 504 pulls the flywheel in a first direction, and the flywheel spools up cable 502 thereby providing a resistance force. Similarly, as the user presses down on the toe end of the pedal, cable 502 pulls the flywheel in a second direction, and the flywheel spools up cable 504 thereby providing a resistance force.

Referring to FIG. 25, yet another example flywheel-based feedback device is provided. The flywheel 520 may pivot about an axis 522 that is parallel to the pivot axis of pedal 136. A cable 524 may be wrapped around the flywheel 520. As the pedal 136 is pivoted, the cable 524 may pull the flywheel via friction between the cable and the flywheel, thereby providing a resistance force.

In some embodiments, the cables 502, 504, 524 may drive pulleys that are rotationally fixed, via a shared shaft, to their respective flywheels. Said driven pulleys may have smaller diameters than their respective flywheels so that smaller movements of the cables' respective ends cause respectively larger angular movement of the flywheels. The mass and dimensions of the flywheels 486, 510, and 520 may be selected to provide a predetermined amount of inertia.

FIG. 26 illustrates another example feedback device system that uses a damper (such as described with respect to FIG. 6), but instead of the damper interacting via gears, the damper 710 interacts with a belt 766. Notably, the stationary damper 710 includes teeth receiving notches 712 that are designed to receive corresponding teeth 767 in the belt 766. Thus, as the foot pedal 736 tilts, the belt 766 causes the damper 710 to rotate to thereby provide the desired resistance force. Notably, other connection methods between the belt and damper are contemplated (e.g., the teeth could be on the damper and the notches or holes on the belt, there could be a single connection point, etc.)

In some embodiments, such as some of the above described embodiments, the feedback device includes a motor, brake, or other feature that can prevent further tilting (change in angular position) of the foot pedal. In such embodiments, the feedback device may be configured to prevent angular movement of the foot pedal, such as when it is determined that the corresponding rotation of the direction of the trolling motor shaft has ceased (or can't go any further—such as due to mud, rocks, stalling, etc.).

Similarly, in some embodiments, the feedback device may operate independently of the user providing input to the foot pedal and may drive the angular position of the foot pedal to stay in sync with the direction of trolling motor shaft. As an example, the trolling motor shaft may be changing direction autonomously, such as during performance of a virtual anchoring feature. In response, and without the user providing input, the feedback device may cause the foot pedal to change its angular position to match how the trolling motor shaft is turning. This provides a visual clue to the user that the direction of the trolling motor shaft is changing.

Example Foot Pedal Switches

As detailed herein, some embodiments of the present invention provide a foot pedal assembly configured for remotely controlling a trolling motor assembly. In some embodiments, one or more switches may be attached to the foot pedal adjacent to the pedal's upper (e.g., an engagement) surface and that pivot with the pedal so that they stay in the same position with respect to the pivoting pedal's upper surface. Accordingly, this configuration makes it easier to access the buttons regardless of the pedal's orientation. Notably, in comparison, in pedal designs in which buttons are attached to the fixed support plate in the front, when the pedal is pivoted so that the heel edge is proximate the support plate, the buttons are difficult to press, and when the pedal is pivoted so that the toe edge is proximate the support plate, the buttons are subject to accidental activation.

Referring to FIGS. 3-4, in some embodiments, one or more buttons 600 may be disposed on the foot pedal 136. The buttons may be disposed adjacent an engagement surface on the pedal's upper surface so that they are outside of a user's footprint when the user rests a foot on the pedal, yet sufficiently proximate the footprint so that the buttons are accessible via a user pivoting his or her foot about the toe and pressing with the heel. That is, the foot pedal may define an engagement surface that is sized to receive a user's foot (e.g., shoe sole). The buttons 600 may be disposed adjacent the engagement surface so that the user may place a foot on the pedal without actuating the buttons 600. In some embodiments, the buttons 600 may be disposed proximate a front edge of the foot pedal such that a user may utilize their toes to activate the buttons. In some embodiments, the foot pedal may have two buttons on each side, one in front of the other in the pedal's longitudinal dimension. That is, the pedal may include two front buttons 600A and two rear buttons 600B, such as shown in FIG. 3.

In some embodiments, the buttons may be actuatable by a downward force that is less than the force required to pivot the pedal. For example, in some embodiments, the force required to actuate each of the buttons times the buttons' respective distance from the pedal's pivotal axis may be less than the torque required to overcome the static friction that holds the pedal in place.

In some embodiments, the buttons may be pivotably attached to the pedal so that they attach at a proximal end 602 and deflect downward when pressed. In this way, the buttons may be difficult to press when pressed near their proximal side, thereby preventing accidental actuation. Moreover, the buttons may have raised portions 606 near or at their respective distal ends 604. In this way, a user pressing down across a button's entire surface with a flat foot or shoe sole engages the raised portions 606, thereby directing the user's downward force to the distal end and maximizing the torque about the button's pivotal axis and minimizing the force required to actuate the button. Accordingly, it may be difficult to actuate the buttons from a position close to the engagement surface yet easy to press the buttons at a position further from the engagement surface, thereby minimizing accidental actuation while maximizing ease of intentional actuation.

The raised portions 606 may extend parallel to the main length dimension of the pedal's upper surface. The raised portions of the distal ends may, for example, be protrusions that extend along the distal edges 604. The rear buttons may have second raised portions 608 that extend further than the front buttons' raised portions 606. In this way, the user may be able to more easily actuate the rear buttons without accidentally actuating the respective front button on the same side.

In some embodiments, the buttons 600 may activate various operations of the trolling motor assembly (or other systems). For example, the buttons 600 may activate certain navigation operations. When pressed, the buttons may actuate switches that communicate with the controller 179 via processor 180 (shown in FIG. 7). One button 600 may, for example, cause the trolling motor to maintain a heading. Another button 600 may be a "virtual anchor," that causes the trolling motor to maintain the boat at a specific location (e.g., by maintaining GPS coordinates). Yet another button 600 may cause the boat to head to a waypoint. Accordingly, said buttons 600 may actuate the processor 116 to actuate autopilot navigation assembly 126. Other buttons 600 may be programmable. For example, a user may determine the desired operation that corresponds to the specific button. In this regard, a user interface may enable configuration by the user—enabling user specific button configurations.

Referring again to FIGS. 3-4, example embodiments of foot pedal assemblies in accordance with the present invention may include a depressable momentary button 142 that may be positioned on either the left or the right side of the housing of the foot pedal assembly 130. Depending on the desired configuration, the momentary button 142 may control whether power is supplied to the propulsion motor and/or the corresponding speed of the propulsion motor. As shown, the button 142 is positioned on the left side of the foot pedal assembly 130.

As previously noted, in some embodiments, a pressure sensor (switch) for controlling operation/rate of direction change of the propeller 112 via the propulsion motor 111 may be operated by a user via the depressable momentary button 142. In some embodiments, as a user depresses the button 142 onto the corresponding pressure sensor, a pressure, or force, may be applied to the pressure sensor and the sensor measures the amount of pressure. As the amount of pressure on the button 142 is increased, the amount of pressure measured by the pressure sensor also increases. In some embodiments, rate of turn of the direction of the trolling motor shaft may be a function of the magnitude of the force measured by the pressure sensor. In this regard, as the amount of force exerted on the pressure sensor by the button 142 increases, the rate of turn of the direction of the trolling motor shaft may also increase, for example, proportionally based on a linear or exponential function. Further information regarding operation concerning an example pressure sensor and momentary switch can be found in U.S. application Ser. No. 15/835,752, entitled "Foot Pedal for a Trolling Motor Assembly", which is assigned to the Assignee of the present invention and incorporated by reference herein in its entirety.

As shown, in some embodiments, the variable speed feature of the trolling motor assembly 100, may be controlled by the speed wheel 197. For example, the speed wheel 197 may be used to select a scale number between "0" and "10," thereby limiting the top end speed of the trolling motor assembly 100 that is achievable via depressing the button 142. For example, where a trolling motor assembly 100 has a maximum speed of 10 mph when the speed wheel 197 is set on scale number "10," the maximum speed achievable by the trolling motor assembly 100 will only be 5 mph when the speed wheel 197 is set on scale number "5." Note, the use of a scale from "0 to 10" is only selected for the sake of example, other scales may be used to represent the range of speeds selectable by the user. As well, in alternate embodiments a linear-type input device, such as a slide, may be utilized rather than the rotary-type speed wheel to input speed control commands.

As well, in some example embodiments, the speed wheel 197 may be used to select a range of speeds within which the trolling motor assembly operates. For example, in addition to, or in place of, the previously discussed scale of "0" to "10," the speed wheel 197 may include ranges of speeds such as, but not limited to, "0-3," "3-6" and "6-10." As such, if a user select the range of "3-6," the trolling motor assembly will operate within that range when activated. Note, the noted ranges do not necessarily reflect actual speeds unless the top speed achievable by the trolling motor assembly 100 happens to be 10 mph.

Example System Architecture

FIG. 7 shows a block diagram of a trolling motor assembly 100 in communication with a navigation control device 131. As described herein, it is contemplated that while certain components and functionalities of components may be shown and described as being part of the trolling motor assembly 100 or the navigation control device 131, according to some example embodiments, some components (e.g., the autopilot navigation assembly 126, portions of the sonar assembly 118, functionalities of the processors 124 and 180, or the like) may be included in the other of the trolling motor assembly 100 or the navigation control device 131 (or in other systems/assemblies altogether).

As depicted in FIG. 7, the trolling motor assembly 100 may include a processor 116, a memory 120, a speed actuator 128, a steering actuator 129, a propulsion motor 111, and a communication interface 124. According to some example embodiments, the trolling motor assembly 100 may also include an autopilot navigation assembly 126 and a sonar assembly 118.

The processor 116 may be any means configured to execute various programmed operations or instructions stored in a memory device such as a device or circuitry operating in accordance with software or otherwise embodied in hardware or a combination of hardware and software (e.g., a processor operating under software control or the processor embodied as an application specific integrated circuit (ASIC) or field programmable gate array (FPGA) specifically configured to perform the operations described herein, or a combination thereof) thereby configuring the device or circuitry to perform the corresponding functions of the processor 116 as described herein. In this regard, the processor 116 may be configured to analyze electrical signals communicated thereto, for example in the form of a speed input signal received via the communication interface 124, and instruct the speed actuator to rotate the propulsion motor 111 (FIG. 2) and, therefore, propeller 112 (FIG. 2) in accordance with a received desired speed.

The memory 120 may be configured to store instructions, computer program code, trolling motor steering codes and instructions, marine data (such as sonar data, chart data, location/position data), and other data in a non-transitory computer readable medium for use, such as by the processor 116.

The communication interface 124 may be configured to enable connection to external systems (e.g., trolling motor assembly 100, a remote marine electronic device, etc.). In this manner, the processor 116 may retrieve stored data from remote, external servers via the communication interface 124 in addition to or as an alternative to the memory 120.

The processor 116 may be in communication with and control the speed actuator 128. Speed actuator 128 may be electronically controlled to cause the propulsion motor 111 to rotate the propeller at various rates (or speeds) in response to respective signals or instructions. As described above with respect to speed actuator 128, speed actuator 128 may be disposed in either the main housing 110 or the trolling motor housing 108, and is configured to cause rotation of the propeller in response to electrical signals. To do so, speed actuator 128 may employ a solenoid configured to convert an electrical signal into a mechanical movement.

The propulsion motor 111 may be any type of propulsion device configured to urge a watercraft through the water. As noted, the propulsion motor 111 is preferably variable speed to enable the propulsion motor 111 to move the watercraft at different speeds or with different power or thrust.

According to some example embodiments, the autopilot navigation assembly 126 may be configured to determine a destination (e.g., via input by a user) and route for a watercraft and control the steering actuator 129, via the processor 116, to steer the propulsion motor 111 in accordance with the route and destination. In this regard, the processor 116 and memory 120 may be considered components of the autopilot navigation assembly 126 to perform its functionality, but the autopilot navigation assembly 126 may also include position sensors. The memory 120 may store digitized charts and maps to assist with autopilot navigation. To determine a destination and route for a watercraft, the autopilot navigation assembly 126 may employ a position sensor, such as, for example, a global positioning system (GPS) sensor (e.g., a positioning sensor). Based on the route, the autopilot navigation assembly 126 may determine that different rates of turn for propulsion may be needed to efficiently move along the route to the destination. As such, the autopilot navigation assembly 126 may instruct the steering actuator 128, via the processor 116, to turn.

The sonar assembly 118 may also be in communication with the processor 116, and the processor 116 may be considered a component of the sonar assembly 118. The sonar assembly 118 may include a sonar transducer that may be affixed to a component of the trolling motor assembly 100 (e.g., on the outside or inside of the main housing) that is disposed underwater when the trolling motor assembly 100 is operating. In this regard, the sonar transducer may be in a housing and configured to gather sonar data from the underwater environment surrounding the watercraft. Accordingly, the processor 116 (such as through execution of computer program code) may be configured to receive sonar data from the sonar transducer, and process the sonar data to generate an image based on the gathered sonar data. In some example embodiments, the sonar assembly 118 may be used to determine depth and bottom topography, detect fish, locate wreckage, etc. Sonar beams, from the sonar transducer, can be transmitted into the underwater environment and echoes can be detected to obtain information about the environment. In this regard, the sonar signals can reflect off objects in the underwater environment (e.g., fish, structure, sea floor bottom, etc.) and return to the transducer, which converts the sonar returns into sonar data that can be used to produce an image of the underwater environment.

As mentioned above, the trolling motor assembly 100 may be in communication with a navigation control device 131 that is configured to control the operation of the trolling motor assembly 100. In this regard, the navigation control device 131 may include a processor 180, a memory 184, a communication interface 186, and a user input assembly 130.

The processor 180 may be any means configured to execute various programmed operations or instructions stored in a memory device such as a device or circuitry operating in accordance with software or otherwise embodied in hardware or a combination of hardware and software (e.g., a processor operating under software control or the processor embodied as an application specific integrated circuit (ASIC) or field programmable gate array (FPGA) specifically configured to perform the operations described herein, or a combination thereof) thereby configuring the device or circuitry to perform the corresponding functions of the processor 180 as described herein. In this regard, the processor 180 may be configured to analyze signals from the user input assembly 130 and convey the signals or variants of the signals, via the communication interface 186 to the trolling motor assembly 100 to cause the trolling motor assembly 100 to operate accordingly.

The memory 184 may be configured to store instructions, computer program code, trolling motor steering codes and instructions, marine data (such as sonar data, chart data, location/position data), and other data in a non-transitory computer readable medium for use, such as by the processor 180.

The communication interface 186 may be configured to enable connection to external systems (e.g., communication interface 124, a remote marine electronics device, etc.). In this manner, the processor 180 may retrieve stored data from a remote, external server via the communication interface 186 in addition to or as an alternative to the memory 184.

Communication interfaces 124 and 180 may be configured to communicate via a number of different communication protocols and layers. For example, the link between the communication interface 124 and communication interface 186 any type of wired or wireless communication link. For example, communications between the interfaces may be conducted via Bluetooth, Ethernet, the NMEA 2000 framework, cellular, WiFi, or other suitable networks.

According to various example embodiments, the processor 180 may operate on behalf of both the trolling motor assembly 100 and the navigation control device 131. In this regard, processor 180 may be configured to perform some or all of the functions described with respect to processor 116 and may communicate directly to the autopilot navigation assembly 126, the sonar assembly 118, the steering actuator 129, and the speed actuator 128 directly via a wired or wireless communication.

The processor 180 may also interface with the user input assembly 130 to obtain information including a desired speed of the propulsion motor based on user activity. In this regard, the processor 180 may be configured to determine a desired speed of operation based on user activity detected by the user input assembly 130, and generate a speed input signal. The speed input signal may be an electrical signal indicating the desired speed. Further, the processor 180 may be configured to direct the speed actuator 128, directly or indirectly, to rotate the shaft of the propulsion motor 111 at a desired speed based on the speed indicated in the steering input signal. According to some example embodiments, the processor 180 may be further configured to modify the rate of rotation indicated in the speed input signal to different values based on variations in the user activity detected by the user input assembly 130.

Various example embodiments of a user input assembly 130 may be utilized to detect the user activity and facilitate generation of a steering input signal indicating a desired speed of propulsion motor. To do so, various sensors including feedback sensors, and mechanical devices that interface with the sensors, may be utilized. For example, a deflection sensor 182 and a pressure sensor 143 may be utilized as sensors to detect user activity. Further, the foot pedal 136 and depressable momentary button 142 may be mechanical devices that are operably coupled to the sensors and may interface directly with a user to facilitate various operations via the user input assembly 130 (i.e. foot pedal assembly).

According to some example embodiments, the buttons 600 may activate various operations of the trolling motor assembly or other systems. As noted herein, in some embodiments, the buttons 600 may be user configurable.

In some embodiments, one or more of the functions described herein may be embodied by computer program instructions of a computer program product. In this regard, the computer program product(s) which embody the procedures described herein may be stored by, for example, the memory 120 or 184 and executed by, for example, the processor 116 or 180. As will be appreciated, any such computer program product may be loaded onto a computer or other programmable apparatus to produce a machine, such that the computer program product including the instructions which execute on the computer or other programmable apparatus creates means for implementing the functions described herein. Further, the computer program product may comprise one or more non-transitory computer-readable mediums on which the computer program instructions may be stored such that the one or more computer-readable memories can direct a computer or other programmable device to cause a series of operations to be performed on the computer or other programmable apparatus to produce a computer-implemented process such that the instructions which execute on the computer or other programmable apparatus implement the functions specified in the flowchart block(s).

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A user input assembly for controlling operation of a trolling motor assembly, wherein the trolling motor assembly comprises a propulsion motor, the user input assembly comprising:

a support plate;

a foot pedal pivotably mounted to the support plate about a first axis, wherein the foot pedal includes a top surface that defines a left edge, right edge, a toe edge, and a heel edge, wherein the top surface comprises an engagement surface that is sized to receive a user's foot thereon;

a switch disposed on the foot pedal adjacent to and outside of the engagement surface, wherein the switch is disposed on the foot pedal such that the switch pivots with the foot pedal, wherein the switch is associated with at least one function corresponding to the trolling motor assembly or a watercraft on which the trolling motor assembly is mounted, wherein the at least one function associated with the switch is directed to maintaining the watercraft at a virtual anchor position; and a controller configured to:

determine an instance in which the switch is activated; and cause, in response to determining an instance in which the switch is activated, an indication that the switch has been activated to be provided to a remote computing device for causing execution of the function associated with the switch.

2. The user input assembly of claim 1, wherein the switch defines a body comprising a main portion and a raised portion, wherein the raised portion extends upwardly from the main portion so that the raised portion comprises a highest portion of the switch in a vertical dimension.

3. The user input assembly of claim 2, wherein the switch comprises a proximate end and a distal end, wherein the proximate end is closer to the engagement surface than the distal end, and wherein the raised portion is positioned closer to the distal end of the switch than the proximate end of the switch.

4. The user input assembly of claim 1, wherein the switch is disposed on the foot pedal closer to the toe edge than to the heel edge.

5. The user input assembly of claim 1, wherein the user input assembly comprises a second switch disposed on the foot pedal adjacent to and outside of the engagement surface, wherein the second switch is disposed on the foot pedal such that the second switch pivots with the foot pedal.

6. The user input assembly of claim 5, wherein the first switch and second switch are disposed on a same side of the engagement surface.

7. The user input assembly of claim 5, wherein the first switch is disposed on a first side of the engagement surface and the second switch is disposed on a second side of the engagement surface that is opposite the first side, wherein the first switch is pivotally mounted to the user input assembly, and wherein the second switch is pivotally mounted to the user input assembly.

8. The user input assembly of claim 7, wherein the first switch and the second switch are pivotally mounted to a same axis.

9. A system comprising:

a trolling motor;

a controller configured to cause the trolling motor to change at least one of a speed or an angle of orientation; and a user input assembly comprising:

a support plate, a foot pedal pivotably mounted to the support plate about a first axis, wherein the foot pedal includes a top surface that defines a left edge, a right edge, a toe edge, and a heel edge, wherein the top surface comprises an engagement surface that is sized to receive a user's foot thereon, and a switch disposed on the foot pedal adjacent to and outside of the engagement surface, wherein the switch is disposed on the foot pedal such that the switch pivots with the foot pedal, wherein the switch is associated with at least one function corresponding to the trolling motor or a watercraft on which the trolling motor is mounted, wherein the at least one function is programmable to perform a user-selected function, wherein the controller is configured to:

determine an instance in which the switch is activated; and cause, in response to determining an instance in which the switch is activated, execution of the function associated with the switch.

10. The system of claim 9, wherein the switch defines a body comprising a main portion and a raised portion, wherein the raised portion extends upwardly from the main portion so that the raised portion comprises a highest portion of the switch in a vertical dimension.

11. The system of claim 10, wherein the switch comprises a proximate end and a distal end, wherein the proximate end is closer to the engagement surface than the distal end, and wherein the raised portion is positioned closer to the distal end than the proximate end.

12. The system of claim 9, wherein the user input assembly comprises a second switch disposed on the foot pedal adjacent to and outside of the engagement surface, wherein the second switch is disposed on the foot pedal such that the second switch pivots with the foot pedal.

13. The system of claim 12, wherein the first switch and second switch are disposed on a same side of the engagement surface.

14. The system of claim 12, wherein the first switch is disposed on a first side of the engagement surface and the second switch is disposed on a second side of the engagement surface that is opposite the first side, wherein the first switch is pivotally mounted to the user input assembly, and wherein the second switch is pivotally mounted to the user input assembly.

15. The system of claim 14, wherein the first switch and the second switch are pivotally mounted to a same axis.

16. A user input assembly for controlling operation of a trolling motor assembly, wherein the trolling motor assembly comprises a propulsion motor, the user input assembly comprising:

a support plate;

a foot pedal pivotably mounted to the support plate about a first axis, wherein the foot pedal includes a top surface that comprises an engagement surface that is sized to receive a user's foot thereon; and a switch disposed on the foot pedal adjacent to and outside of the engagement surface, wherein the switch is disposed on the foot pedal such that the switch pivots with the foot pedal, wherein the switch is associated with at least one function corresponding to the trolling motor assembly or a watercraft on which the trolling motor assembly is mounted, wherein the at least one function is programmable to perform a user-selected function.

17. The user input assembly of claim 16 further comprising a feedback device coupled with the foot pedal and configured to, in response to pivotal movement of the foot pedal about the first axis, provide a resistance force to the pivotal movement.

18. A system comprising:

a trolling motor;

a controller configured to cause the trolling motor to change at least one of a speed or an angle of orientation; and a user input assembly comprising:

a support plate, a foot pedal pivotably mounted to the support plate about a first axis, wherein the foot pedal includes a top surface that defines a left edge, a right edge, a toe edge, and a heel edge, wherein the top surface comprises an engagement surface that is sized to receive a user's foot thereon, and a switch disposed on the foot pedal adjacent to and outside of the engagement surface, wherein the switch is disposed on the foot pedal such that the switch pivots with the foot pedal, wherein the switch is associated with at least one function corresponding to the trolling motor or a watercraft on which the trolling motor is mounted, wherein the at least one function associated with the switch is directed to maintaining the watercraft at a virtual anchor point, wherein the controller is configured to:

determine an instance in which the switch is activated; and cause, in response to determining an instance in which the switch is activated, execution of the function associated with the switch.

19. A user input assembly for controlling operation of a trolling motor assembly, wherein the trolling motor assembly comprises a propulsion motor, the user input assembly comprising:

a support plate;

a foot pedal pivotably mounted to the support plate about a first axis, wherein the foot pedal includes a top surface that comprises an engagement surface that is sized to receive a user's foot thereon; and a switch disposed on the foot pedal adjacent to and outside of the engagement surface, wherein the switch is disposed on the foot pedal such that the switch pivots with the foot pedal, wherein the switch is associated with at least one function corresponding to the trolling motor assembly or a watercraft on which the trolling motor assembly is mounted, wherein the at least one function associated with the switch is maintaining the watercraft at a virtual anchor point.

20. A user input assembly for controlling operation of a trolling motor assembly, wherein the trolling motor assembly comprises a propulsion motor, the user input assembly comprising:

a support plate;

a foot pedal pivotably mounted to the support plate about a first axis, wherein the foot pedal includes a top surface that defines a left edge, right edge, a toe edge, and a heel edge, wherein the top surface comprises an engagement surface that is sized to receive a user's foot thereon;

a switch disposed on the foot pedal adjacent to and outside of the engagement surface, wherein the switch is disposed on the foot pedal such that the switch pivots with the foot pedal, wherein the switch is associated with at least one function corresponding to the trolling motor assembly or a watercraft on which the trolling motor assembly is mounted wherein the at least one function associated with the switch is programmable to perform a user-selected function; and a controller configured to:

determine an instance in which the switch is activated; and cause, in response to determining an instance in which the switch is activated, an indication that the switch has been activated to be provided to a remote computing device for causing execution of the function associated with the switch.

* * * * *